US009010297B2

(12) United States Patent
Sato et al.

(10) Patent No.: US 9,010,297 B2
(45) Date of Patent: Apr. 21, 2015

(54) ALUMINUM ALLOY MEMBER, ALUMINUM ALLOY PISTON FOR INTERNAL COMBUSTION ENGINE AND MANUFACTURING METHOD THEREOF

(71) Applicant: Hitachi Automotive Systems, Ltd., Hitachinaka-shi, Ibaraki (JP)

(72) Inventors: Takanori Sato, Atsugi (JP); Masato Sasaki, Sagamihara (JP); Norikazu Takahashi, Yokohama (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 25 days.

(21) Appl. No.: 14/021,407

(22) Filed: Sep. 9, 2013

(65) Prior Publication Data

US 2014/0076263 A1 Mar. 20, 2014

(30) Foreign Application Priority Data

Sep. 18, 2012 (JP) ..... 2012-203882
Aug. 1, 2013 (JP) ..... 2013-160028

(51) Int. Cl.

| | |
|---|---|
| ***C25D 11/04*** | (2006.01) |
| ***C25D 3/02*** | (2006.01) |
| ***C25D 5/44*** | (2006.01) |
| ***C25D 11/00*** | (2006.01) |
| ***C25D 11/20*** | (2006.01) |
| ***F02F 3/00*** | (2006.01) |
| *C25D 3/56* | (2006.01) |

(52) U.S. Cl.

CPC ..... *F02F 3/0084* (2013.01); *C25D 3/02* (2013.01); *C25D 3/562* (2013.01); *C25D 3/565* (2013.01); *C25D 5/44* (2013.01); *C25D 11/005* (2013.01); *C25D 11/04* (2013.01); *C25D 11/20* (2013.01); *F02F 3/00* (2013.01)

(58) Field of Classification Search

USPC ..... 123/193.6, 668; 205/151, 172, 174
See application file for complete search history.

(56) References Cited

U.S. PATENT DOCUMENTS

| | | | | | |
|---|---|---|---|---|---|
| 3,943,039 | A * | 3/1976 | Wittrock | 205/172 |
| 4,042,468 | A * | 8/1977 | Hasegawa et al. | 205/174 |
| 4,166,776 | A * | 9/1979 | Lefebvre et al. | 205/151 |
| 2006/0037866 | A1* | 2/2006 | Yamamoto et al. | 205/324 |
| 2006/0101992 | A1* | 5/2006 | Hiratsuka | 92/172 |
| 2012/0042859 | A1* | 2/2012 | Sakai | 123/668 |

FOREIGN PATENT DOCUMENTS

JP 2010-090427 A 4/2010

OTHER PUBLICATIONS

JIS H 5202, Aluminium Alloy Castings, Japanese Industrial Standard, 1999.

* cited by examiner

*Primary Examiner* — M. McMahon
(74) *Attorney, Agent, or Firm* — Foley & Lardner LLP

(57) ABSTRACT

A piston for an internal combustion engine includes a piston body made of an aluminum alloy material containing silicon and having a piston ring groove formed therein and an anodic oxide film formed on the piston ring groove, wherein a metal containing nickel and zinc is deposited around silicon particles in the anodic oxide film.

20 Claims, 13 Drawing Sheets

ALUMINUM ALLOY MEMBER, ALUMINUM ALLOY PISTON FOR INTERNAL COMBUSTION ENGINE AND MANUFACTURING METHOD THEREOF

BACKGROUND OF THE INVENTION

The present invention relates to an aluminum alloy member and a manufacturing method thereof and, more particularly, to a piston for an internal combustion engine a manufacturing method thereof.

There is conventionally known a piston for an internal combustion engine, which has a piston body made of an aluminum alloy material. It is common practice to anodize a top ring groove of the piston (in which a top ring is fitted) and thereby form an anodic oxide film on a surface of the top ring groove for improvements in wear resistance and corrosion resistance. This type of aluminum alloy piston faces a technical problem that there occur clearances between the anodic oxide film and silicon particles contained in the aluminum alloy material due to the growth and expansion of the anodic oxide film.

As a solution to such a problem, Japanese Laid-Open Patent Publication No. 2010-90427 proposes a technique for reinforcing an anodic oxide film on an aluminum alloy material by, after the formation of the anodic oxide film, immersing the anodic oxide film in an aqueous solution containing magnesium ions, ammonium ions and fluoride ions for a predetermined time and thereby allowing a compound containing magnesium and fluorine to be deposited in clearances between the anodic oxide film and silicon particles contained in the aluminum alloy material.

SUMMARY OF THE INVENTION

In the above-proposed reinforcement technique, however, the deposited magnesium/fluorine-containing compound is not still sufficient in strength so that it is impossible to secure the sufficient strength of the anodic oxide film.

It is accordingly an object of the present invention to provide an aluminum alloy piston for an internal combustion engine or an aluminum alloy member, in which an anodic oxide film is formed with sufficient strength.

According to one aspect of the present invention, there is provided a piston for an internal combustion engine, comprising: a piston body made of an aluminum alloy material containing silicon and having a piston ring groove formed therein; and an anodic oxide film formed on the piston ring groove, wherein a metal containing nickel and zinc is deposited around silicon particles in the anodic oxide film.

According to another aspect of the present invention, there is provided a method of manufacturing a piston for an internal combustion engine, comprising: producing a piston with a piston ring groove from an aluminum alloy material containing silicon; forming an anodic oxide film on the piston ring groove; and electrolyzing, in an electrolytic solution, a part of the piston on which the anodic oxide film has been formed so as to allow a metal containing nickel and zinc to be deposited around silicon particles in the anodic oxide film.

According to still another aspect of the present invention, there is provided an aluminum alloy member, comprising: a base body made of an aluminum alloy material containing silicon; and an anodic oxide film formed on at least a part of the base body, wherein a metal containing nickel and zinc is deposited around silicon particles in the anodic oxide film.

It is possible according to the present invention to secure the sufficient strength of the anodic oxide film by the deposition of the high-strength metal around the silicon particles in the anodic oxide film.

The other objects and features of the present invention will also become understood from the following description.

DESCRIPTIONS OF THE EMBODIMENTS

Hereinafter, the present invention will be described in detail below with reference to the drawings.

Figure 1:
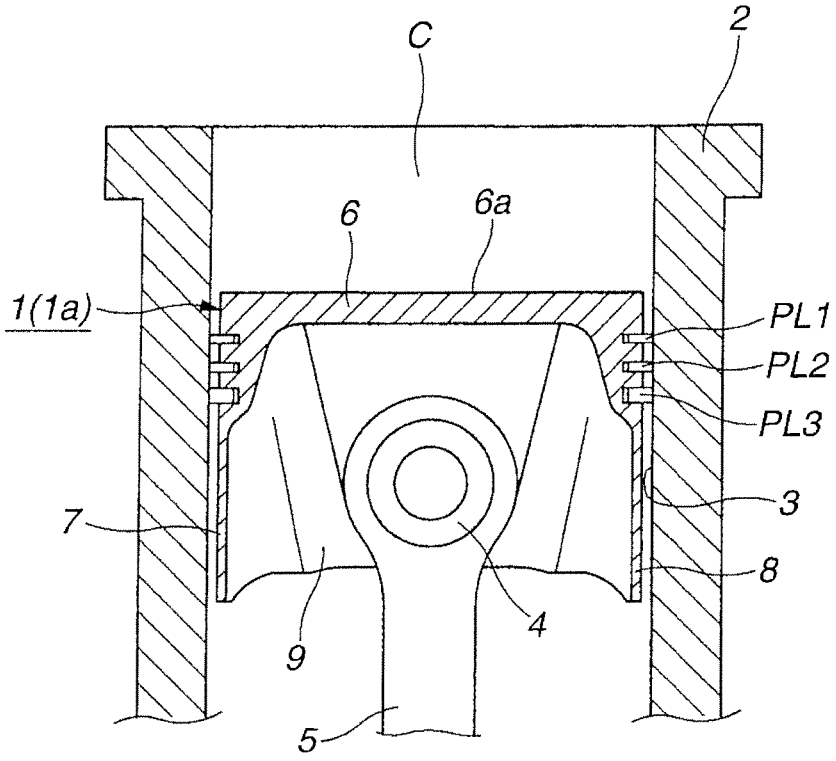
FIG. 1 is a schematic cross section view of an internal combustion engine equipped with a piston according to one embodiment of the present invention.

The following embodiment specifically refers to a piston 1 for an automotive internal combustion engine. In the internal combustion engine, the piston 1 is in sliding contact with a substantially cylindrical cylinder wall 3 of a cylinder block 2 such that a combustion chamber C is defined by the piston 1, the cylinder wall 3 and a cylinder head (not shown) as shown in FIG. 1. A connection rod 5 is coupled to the piston 1 via a piston pin 4 for connection of the piston 1 to a crankshaft (not shown) of the engine.

Figure 2:
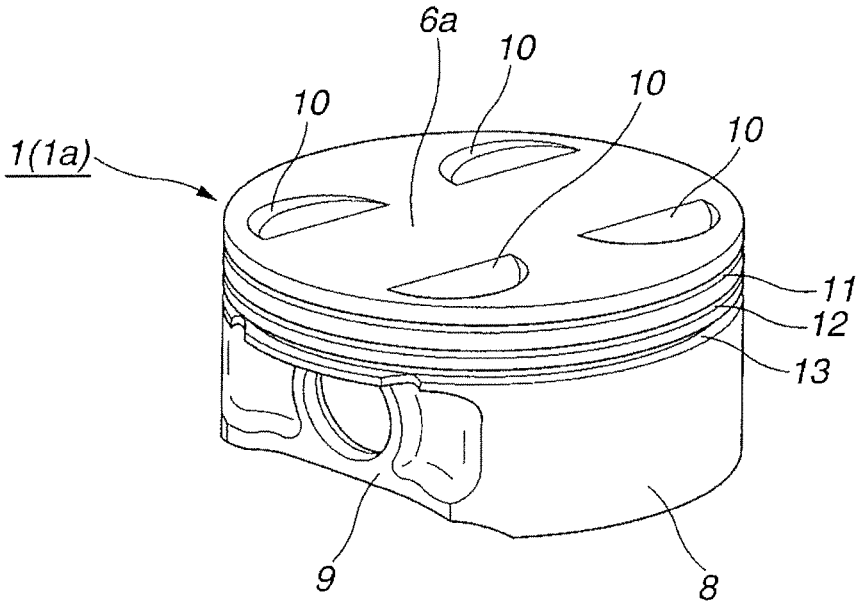
FIG. 2 is a perspective view of the piston of FIG. 1.
Figure 3:
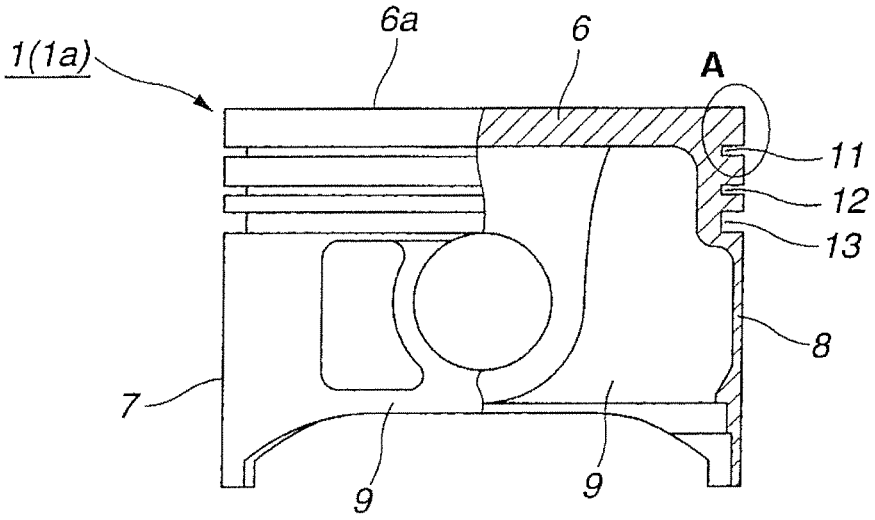
FIG. 3 is a side view, half in cross section, of the piston of FIG. 1.

As shown in FIGS. 1 to 3, the piston 1 has a substantially cylindrical piston body 1*a* integrally casted from a silicon-containing aluminum alloy material (sometimes referred to as "base material 1*b*") such as AC8C and including a crown portion 6, a pair of skirt portions 7 and 8 formed integrally on an outer circumferential bottom end of the crown portion 6 and a pair of apron portions 9 linked between circumferentially opposing ends of the skirt portions 7 and 8.

The crown portion 6 is disc-shaped with a relatively large thickness and has a crown surface 6*a* defining thereon the combustion chamber C. A plurality of valve recesses 10 are made in the crown surface 6*a* for prevention of interference with intake and exhaust valves (not shown). Further, three ring grooves 11, 12 and 13 are cut in the outer circumference surface of the crown portion 6 such that three piston rings PL1, PL2 and PL3 (such as a compression ring, an oil ring etc.) are fitted in the ring grooves 11, 12 and 13, respectively.

Among these ring grooves 11, 12 and 13, the top ring groove 11 is located closest to the combustion chamber C and is thus more susceptible to the influence of combustion in the combustion chamber C.

Figure 4:
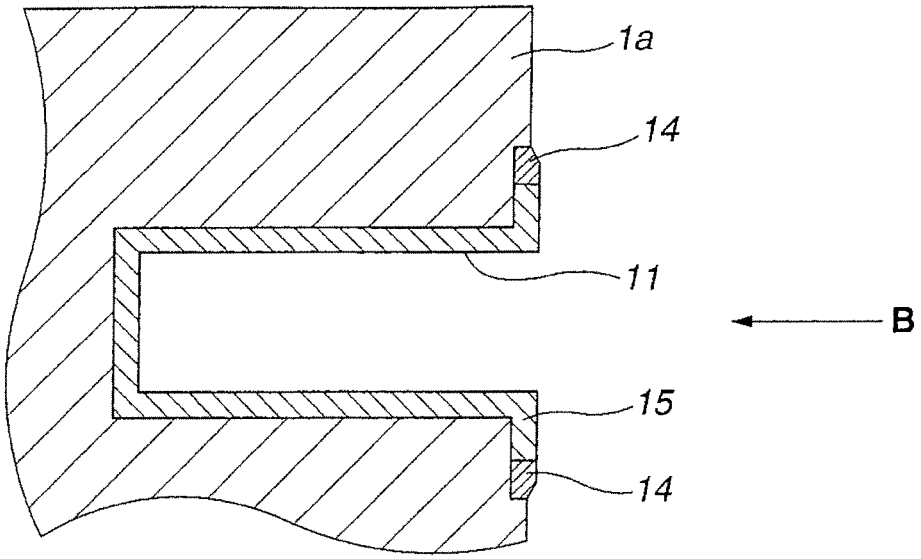
FIG. 4 is an enlarged view of part A of FIG. 1.
Figure 5:
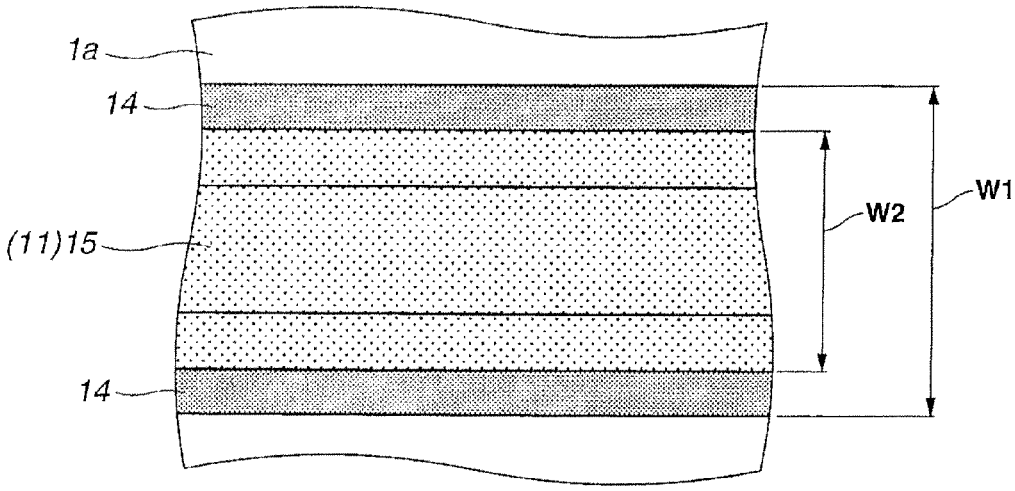
FIG. 5 is a fragmentary view taken in the direction of arrow B of FIG. 4.

In the present embodiment, the piston 1 has an anodization treatment region 14 in which known anodization treatment is performed on the inside and periphery of the top ring groove 11 and an electrolytic deposition treatment region 15 in which electrolytic deposition treatment (as secondary electrolytic treatment after the anodization treatment) is performed on a given area within the anodization treatment region 14 as shown in FIG. 4. Namely, the range W1 of the anodization treatment region 14 is set larger than the range W2 of the electrolytic deposition treatment region 15 in an axial direction of the piston 1 as shown in FIG. 5 in the present embodiment.

Figure 7:
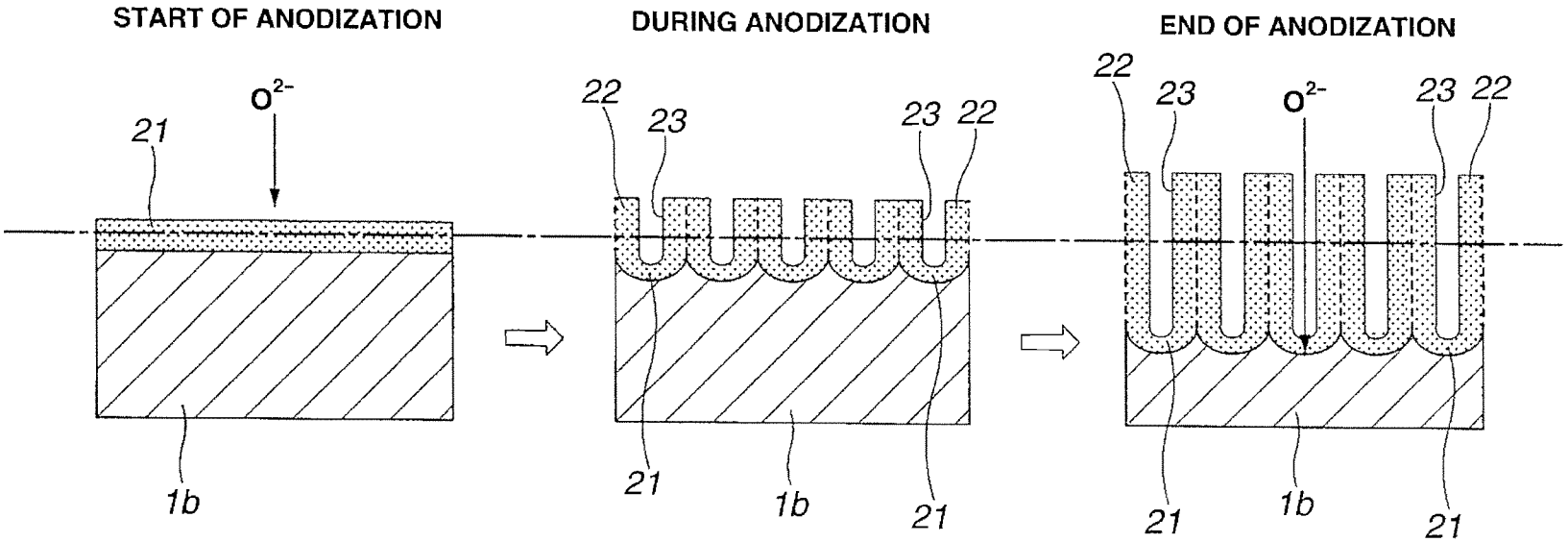
FIG. 7 is a schematic view showing the growth of an anodic oxide film during the anodization treatment.

In the anodization treatment region 14, an anodic oxide film 20 is formed on the piston base material 1*b* as shown in FIG. 7 as a result of the anodization treatment. The anodic oxide film 20 is in the form of an agglomerate of anodic aluminum oxide cells and consists of a barrier layer 21 formed by bottoms of the respective anodic aluminum oxide cells and a porous layer 22 having a plurality of pores 23 formed on the barrier layer 21 by walls of the respective anodic aluminum oxide cells due to the growth (volume expansion) of the anodic oxide film 20. As non-conductive silicon particles 24 are contained in the piston base material 1*b*, there occur some clearances 25 around the silicon particles 24 for the passage of electric current during the anodization treatment (see FIG. 9). Upon completion of the anodization treatment, the silicon particles 24 are incorporated in the anodic oxide film 20 with the clearances 25 left around the silicon particles 24. As the clearances 25 are utilized for the passage of electric current during the anodization treatment, each of the clearances 25 has both ends open to the piston body 1*a* and to the outside of the anodic oxide film 20 so as to provide communication between the piston body 1*a* and the outside of the anodic oxide film 20.

Figure 9:
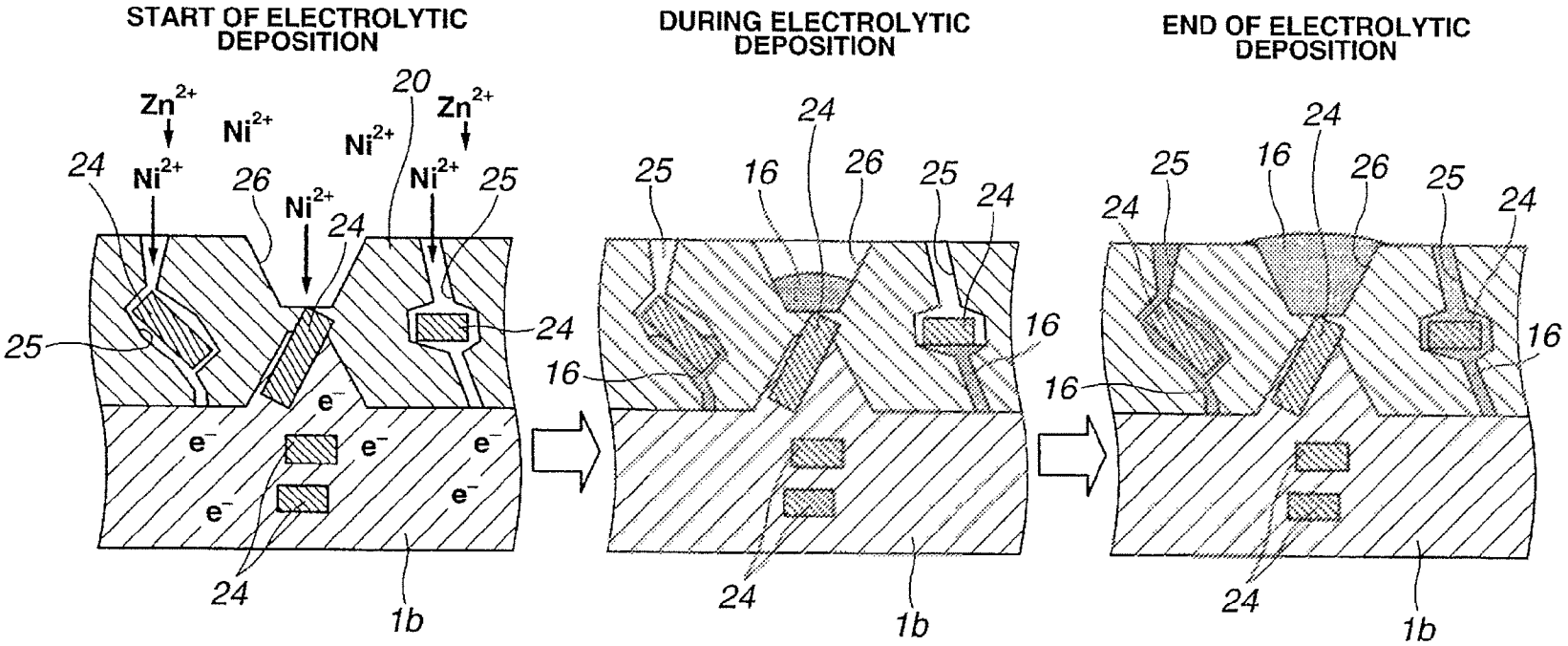
FIG. 9 is a schematic view showing the deposition of a metal in the anodic oxide film during the electrolytic deposition treatment.

In the electrolytic deposition treatment region 15, a relatively high-strength metal 16 such as nickel and zinc is deposited around the silicon particles 24 in the clearances 25 and in surface recesses 26 of the anodic oxide film 20 as shown in FIG. 9 as a result of the electrolytic deposition treatment.

The above-structured piston 1 can be manufactured through the following steps: (1) casting the aluminum alloy material 1*b* into a given shape, thereby forming the piston body 1*a* with the piston rings 11, 12 and 13 etc.; (2) performing the anodization treatment on the top ring groove 11; and (3) performing electrolytic nickel plating treatment as the electrolytic deposition treatment on the given area of the anodization treatment region 14.

Figure 6:
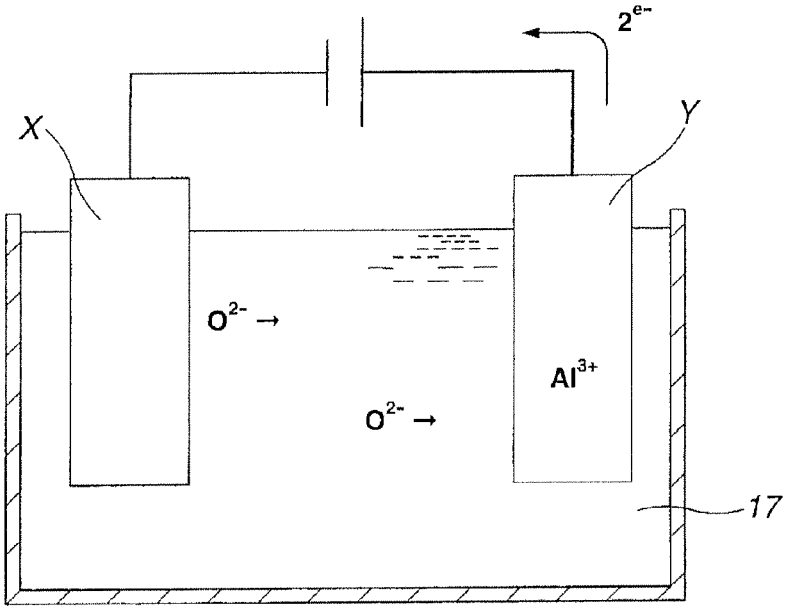
FIG. 6 is a schematic view of anodization treatment.

As shown in FIG. 6, the anodization treatment can be performed by electrolysis using the piston base material 1*b* as an anode Y and using pure titanium as a cathode X in an electrolytic solution 17 of sulfuric acid. The anodic aluminum oxide film 20 is formed on the piston body 1*a* (base material 1*b*) by combination of oxygen ions ($O^{2-}$) dissolved in the electrolytic solution 17 and aluminum ions ($Al^{3+}$) electrolyzed at the anode Y as shown in FIG. 7 in the anodization treatment. More specifically, the barrier layer 21 is first formed with a relatively uniform surface on the piston base material 1*b*. After the barrier layer 21 reaches a predetermined thickness, the porous layer 22 grows on the outside of the barrier layer 21. By the growth of the porous layer 22, the current density is increased in the pores 23. The formation of the porous layer 22 is thus accelerated by the dissolution of the piston base material 1*b* under the electric field. In this way, the growth and formation of the anodic oxide film 20 is completed. It is noted that, in FIG. 7, an alternate long and short dash line represents a reference line indicating the position of the outer surface of the piston base material 1*b* before the anodization treatment.

Figure 8:
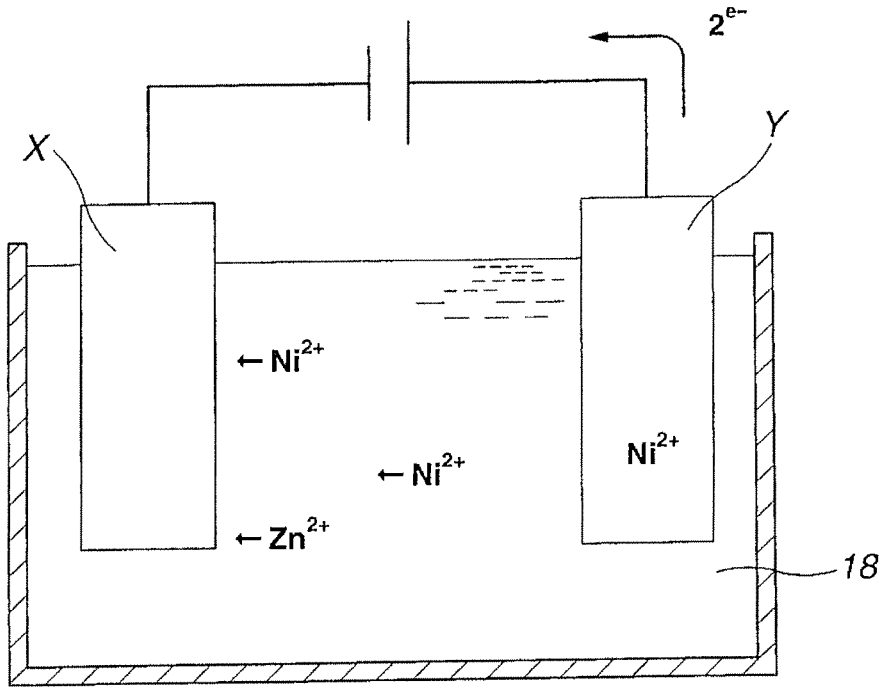
FIG. 8 is a schematic view of electrolytic deposition treatment.

The electrolytic nickel plating treatment can be performed by electrolysis using the piston base material 1*b* with the anodic oxide film 20 as a cathode X and using pure nickel as an anode Y in a predetermined electrolytic solution 18 containing nickel ions ($Ni^{2+}$) and zinc ions ($Zn^{2+}$) as shown in FIG. 8. There can be used, as such an electrolytic solution 18, a black nickel plating solution or a plating solution containing nickel sulfamate $Ni(SO_3NH2)_2$, zinc sulfate ($ZnSO_4$) and boric acid ($H_3BO_3$) etc. As shown in FIG. 9, the metal ions such as nickel ions ($Ni^{2+}$) and zinc ions ($Zn^{2+}$) dissolved in the electrolytic solution 18 pass through the clearances 25 and recesses 26 of the anodic oxide film 20 and act on the piston base material 1*b*. These metal ions are reduced at a contact surface between the piston base material 1*b* and the electrolytic solution 18. As a result, the metal 16 such as nickel and zinc is deposited around the silicon particles 24 in the clearances 25 and in the recesses 26 of the anodic oxide film 20 such that the clearances 25 and recesses 26 are filled with the metal 16.

Figure 10:
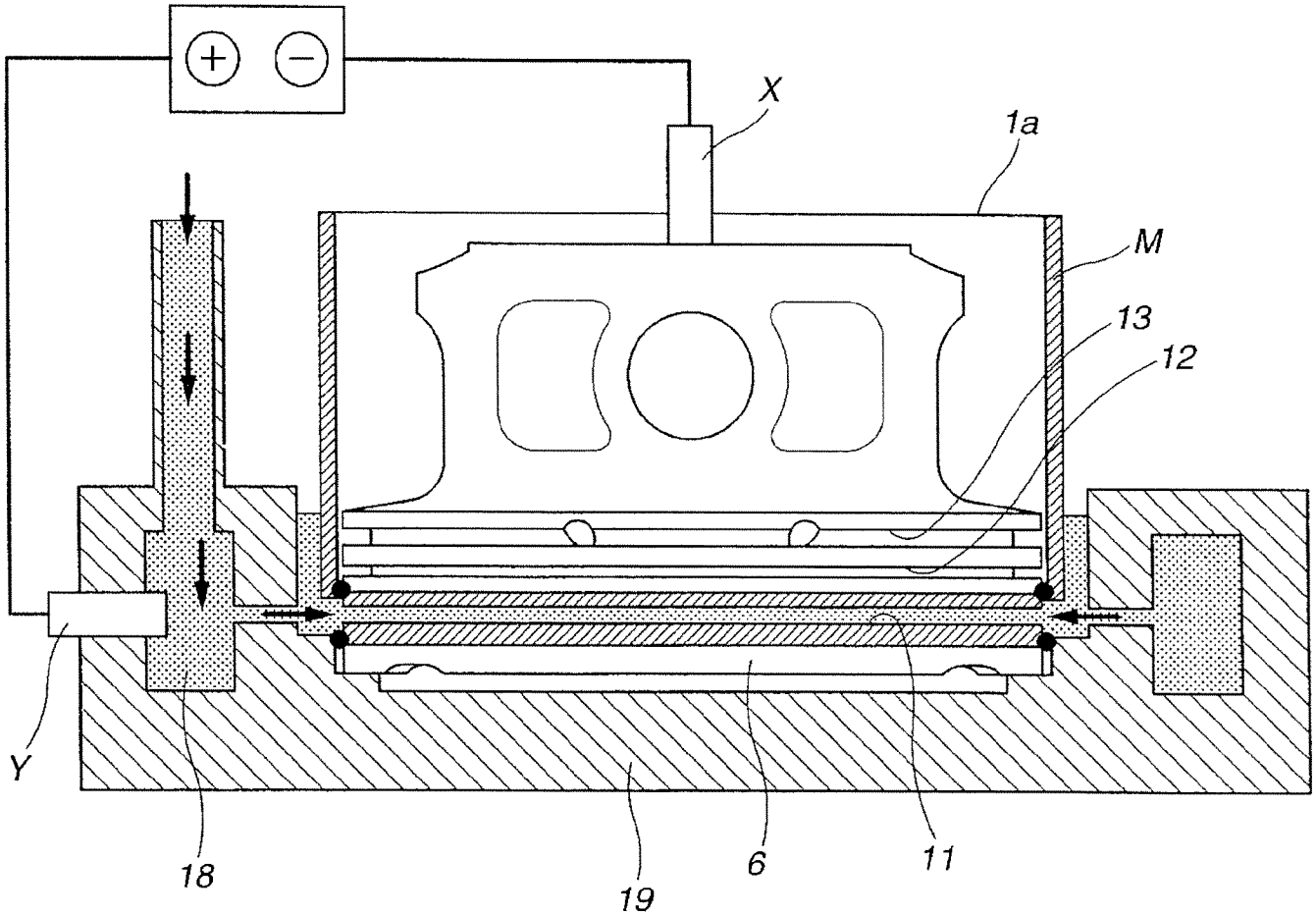
FIG. 10 is a schematic view showing an example of an electrolytic plating apparatus for the electrolytic deposition treatment.

It is herein feasible to perform the electrolytic nickel plating treatment with the use of an apparatus in which the electrolytic solution 18 is stored in an electrolytic bath 19 as shown in FIG. 10. A masking material M is applied to any part of the piston body 1*a* (piston base material 1*b*) other than the range W2 of the electrolytic deposition treatment region 15 in such a manner that only the range W2 of the electrolytic deposition treatment region 15 is exposed to the outside. After that, the crown portion 6 of the piston body 1*a* is immersed in the electrolytic solution 18, with the crown surface 6*a* of the crown portion 6 directed toward the bottom of the electrolytic bath 19. The piston body 1*a* (piston base material 1*b*) is then connected to the cathode X. On the other hand, the anode Y is immersed in the electrolytic solution 18. In this state, the electrolysis is conducted by the passage of electric current between the cathode X and the anode Y. As the axial range W2 of the electrolytic position treatment region 15 is set smaller than the axial range W1 of the anodization treatment region 14 in the present embodiment, it is easier to conduct electrolysis with the application of the masking material M as compared to the case where the anodization treatment region 14 and the electrolytic position treatment region 15 are set to the same range.

The effects of the present invention have been be verified by the following experiments.

In the following experiments, two types of test samples: one type of which was subjected to only anodization treatment (referred to as "test sample 1") and the other type of which was subjected to anodization treatment and electrolytic nickel plating treatment according to the present invention (referred to as "test sample 2") were prepared and used.

[Experiment 1: Comparison Between Anodic Oxide Film According to the Present Invention and Conventional Anodic Oxide Film]

Test samples 1 and 2 were prepared as follows by using aluminum alloy casting AC8A (according to JIS H5202) as a base material 1*b*. Herein, each of the test samples of types 1 and 2 had a rectangular plate shape with a length of 19 mm, a width of 15 mm and a thickness of 5 mm. The composition of the aluminum alloy material AC8A is indicated in TABLE 1.

TABLE 1

| Base | Chemical composition (wt %) | | | | | | | | |
|---|---|---|---|---|---|---|---|---|---|
| Material | Cu | Si | Mg | Zn | Fe | Mn | Ti | Ni | Al |
| AC8A | 0.8-1.3 | 11.0-13.0 | 0.7-1.3 | ≤0.15 | ≤0.8 | ≤0.15 | ≤0.20 | 0.8-1.5 | balance |

First, the test samples 1 and 2 were subjected to degreasing pretreatment by ultrasonic cleaning in acetone for 5 minutes at room temperature.

After the degreasing pretreatment, the anodization treatment was performed on the test samples 1 and 2 by immersing the test sample as an anode and pure titanium as a cathode in an electrolytic solution of sulfuric acid (sulfuric acid concentration: 200 g/L, temperature: 25±5° C.) and supplying a direct current with a current density of 10.0 A/dm$^2$ for 5 minutes. There was thus formed an anodic oxide film 20 having a thickness of 20 μm on the base material 1*b* in each of the test samples 1 and 2.

The resulting anodized test samples 1 and 2 were subjected to washing with water of pH 5.8 to 8.6 for 1 minute so as to wash away the electrolytic solution therefrom, and then, dried with air blow.

After the washing/drying treatment, the electrolytic nickel plating treatment was performed on the test sample 2 by immersing the test sample as a cathode and pure nickel as an anode in an electrolytic solution and supplying a direct current with a current density of 2.1 A/dm$^2$ for 9 minutes. The electrolytic solution herein used was of the type containing nickel sulfamate, zinc sulfate and boric acid (nickel sulfamate concentration: 300 g/L, zinc sulfate concentration: 30 g/L, boric acid concentration: 30 g/L, temperature: 35±5° C.). By this electrolytic nickel plating treatment, a metal 16 was deposited inside the anodic oxide film 20.

The resulting electrolyzed test sample 2 was subjected to washing with water of pH 5.8 to 8.6 for 1 minute so as to wash away the electrolytic solution therefrom, and then, dried with air blow.

The treatment conditions are summarized in TABLE 2.

TABLE 2

| Step | Conditions |
|---|---|
| Material and Pretreatment | Base material: AC8A<br>(aluminum alloy casting according to JIS H5202)<br>Thickness: 5 mm<br>Treatment area: 0.029 dm$^2$ (19 mm × 15 mm)<br>Degreasing: ultrasonic cleaning in acetone<br>Treatment temperature: room temperature<br>Treatment time: 5 minutes<br>Masking agent: KT Clean AC-818T<br>(manufactured by Kakoki Trading Co., Ltd.) |
| Anodization | Electrolytic solution: sulfuric acid (200 g/L)<br>Treatment temperature: 25 ± 5° C.<br>Cathode: pure titanium<br>Current density: DC (direct current) 10.0 A/dm$^2$<br>Treatment time: 5 minutes<br>Anodic oxide film thickness: 20 μm |
| Washing/drying | Washing with water of pH 5.8 to 8.6<br>Treatment time: 1 minute<br>Drying with air blow |
| Electrolytic deposition | Electrolytic solution:<br>Nickel sulfamate 300 g/L<br>Zinc sulfate 30 g/L<br>Boric acid 30 g/L<br>Treatment temperature: 35 ± 5° C.<br>Anode: pure nickel<br>Current density: DC (direct current) 2.1 A/dm$^2$<br>Treatment time: 9 minutes |
| Washing/drying | Washing with water of pH 5.8 to 8.6<br>Treatment time: 1 minute<br>Drying with air blow |

The thus-obtained test samples 1 and 2 were tested for the damage resistance, composition and surface roughness of the anodic oxide film.

Figure 11:
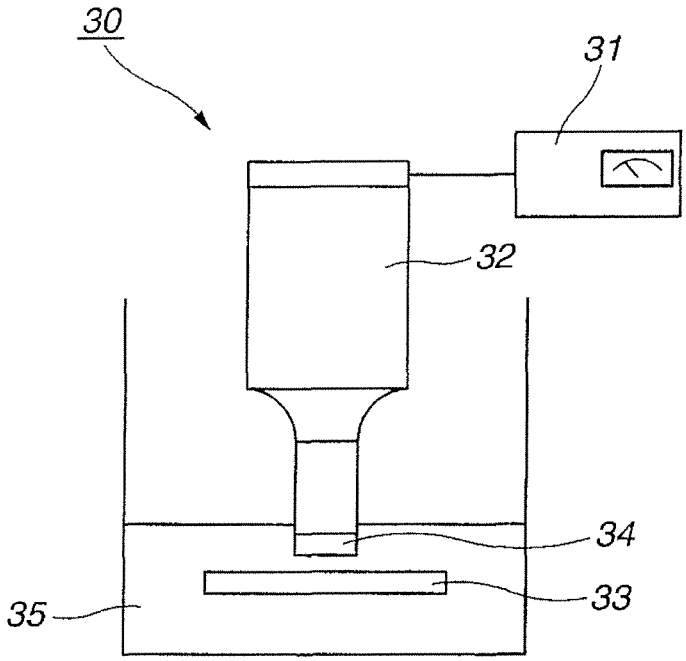
FIG. 11 is a schematic view of a cavitation/erosion test machine used in Experiments 1 to 7.

The damage resistance of the anodic oxide film was determined by a counter vibration test method (cavitation/erosion test method) using a test machine 30 as shown in FIG. 11. The test machine 30 had an ultrasonic oscillator 31 equipped with a magnetostrictive vibrator, a horn 32 connected to the ultrasonic oscillator 31 and a vibration piece 34 formed of stainless steel with a diameter of 16 mm and fixed to a tip end of the horn 32. In this test machine 30, each test sample was set as a test piece 33 so as to face the vibrating piece 34 at a distance of 1 mm in distilled water 35 of room temperature. The vibrating piece 34 was vibrated at an oscillation frequency of 19 Hz for 10 minutes. When air bubbles caused by vibrations of the vibrating pieces 34 were broken at a surface of the test piece 33, there occurred erosion of the surface of the test piece 33.

The damage resistance test conditions are summarized in TABLE 3.

TABLE 3

| Item | Test conditions |
|---|---|
| Damage resistance | Test method: counter vibration test method<br>(cavitation/erosion test method)<br>Test machine: ultrasonic oscillator<br>(rated output: maximum 300 W)<br>Oscillation frequency: 19 kHz<br>Vibration piece on horn end: SUS 304<br>Diameter: 16 mm<br>Weight: 13.5 ± 0.5 g<br>Distance from horn end to test piece: 1.0 mm<br>Test liquid: distilled water (replaced for each test piece)<br>Test temperature: room temperature<br>Test time: 10 min |

The degree of damage to the anodic oxide film was observed with a microscope. Then, the maximum width of the damage center (where damage was heavier in a thickness direction than other parts) was determined as a damage width. The ratio of the damage width of the test sample 2 to the damage width of the test sample 1 was further determined as a damage ratio. The damage resistance of the anodic oxide film was evaluated based on the damage ratio.

The composition of the anodic oxide film was determined by EDX quantitative analysis.

The surface roughness of the anodic oxide film was determined by SEM observation. In this experiment, the test sample 2 was subjected to surface roughness measurement when it was confirmed by EDX quantitative analysis that the nickel content of the test sample was 0.3 atomic % or more. The ratio of the surface roughness of the test sample 2 to the surface roughness of the test sample 1 was determined as a roughness ratio on a percentage basis. The surface roughness of the anodic oxide film was evaluated based on the roughness ratio.

The test/evaluation methods are summarized in TABLE 4.

TABLE 4

| Item | Test/evaluation method |
|---|---|
| Damage resistance | Test point: damage center<br>Test item: damage width<br>Measurement unit: Nikon Measurescope 10 |
| Composition/ Surface roughness | Evaluation threshold<br>Ni content of anodic oxide film: 0.3 at % or more (EDX quantitative analysis value)<br>SEM Observation<br>Measurement unit: Hitachi SU6600<br>EDX analysis<br>Measurement unit: Oxford Instruments INCA Energy 250<br>Acceleration voltage: 20 kV<br>Observation magnification: 10K<br>Analysis range: 12.8 × 9.6 μm<br>Analysis area: four areas in vertical cross section of anodic oxide film (located at around thickness center and containing Si particles) to determine average value of four analysis areas<br>Measurement time: 120 sec<br>Analyzed elements: O, Al, Si. S, Ni, Zn |

Figure 12:
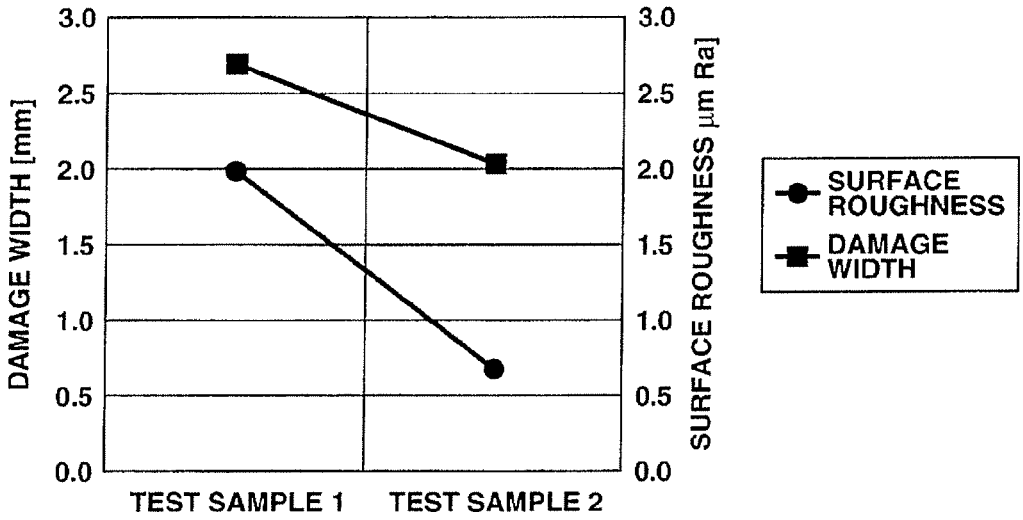
FIG. 12 is a graph showing results of Experiment 1.

As is seen from TABLE 5 and FIG. 12, the test sample 2 had a damage ratio of 35% and a roughness ratio of 76% relative to the test sample 1. It has thus been shown that the anodic oxide film 20 can be improved in damage resistance and surface roughness by combination of the anodization treatment with the electrolytic deposition treatment according to the present invention.

The reason for the above results is considered that, by the electrolytic deposition treatment, the metal 16 such as nickel and zinc is deposited and filled in weak, crack-prone clearances 25 and recesses 26 of the anodic oxide film 20 so as to reinforce the clearances 25 and recesses 26 of the anodic oxide film 20 for improvement of damage resistance and, at the same time, smoothen the surface of the anodic oxide film 20 for improvement of surface roughness.

[Experiment 2: Influence of Si Content of Base Material on Film Performance]

Test samples 1 and 2 were prepared in the same manner as in Experiment 1 by using aluminum alloy materials a to i of different silicon contents as a base material 1*b*. The compositions of the respective aluminum alloy materials a to i used are indicated in TABLE 6.

TABLE 6

| Base material | Chemical composition (wt %) | | | | | | | | |
|---|---|---|---|---|---|---|---|---|---|
| | Cu | Si | Mg | Zn | Fe | Mn | Ti | Ni | Al |
| a | 0.1 | 0.2 | 0.0 | 0.01 | 0.2 | 0.0 | 0.00 | 0.0 | balance |
| b | ≤0.1 | ≤0.1 | 2.5-4.0 | ≤0.40 | ≤0.8 | 0.4-0.6 | ≤0.20 | ≤0.1 | balance |
| c | 0.1 | 0.1 | 0.0 | 0.02 | 0.3 | 0.0 | 0.00 | 0.0 | balance |
| d | 0.1 | 3.9 | 0.0 | 0.02 | 0.3 | 0.0 | 0.00 | 0.0 | balance |
| e | ≤0.2 | 6.5-7.5 | 0.2-0.4 | ≤0.30 | ≤0.5 | ≤0.6 | ≤0.20 | 0.1-1.5 | balance |
| f | 0.8-1.3 | 11.0-13.0 | 0.7-1.3 | ≤0.15 | ≤0.8 | ≤0.15 | ≤0.20 | 0.8-1.5 | balance |
| g | 2.2 | 17.1 | 1.1 | 0.01 | 0.2 | 0.0 | 0.01 | 1.4 | balance |
| h | 0.1 | 24.9 | 0.0 | 0.02 | 0.3 | 0.0 | 0.00 | 0.0 | balance |
| i | 0.1 | 27.9 | 0.0 | 0.02 | 0.3 | 0.0 | 0.00 | 0.0 | balance |

The test/evaluation results of the test samples 1 and 2 are indicated in TABLE 5 and FIG. 12. In TABLE 5, the damage resistance of the anodic oxide film is marked with: the symbol "○" when the damage ratio was smaller than 50%; the symbol "Δ" when the damage ratio was larger than or equal to 50% and smaller than 80%; and the symbol "X" when the damage ratio was larger than or equal to 80%; and the surface roughness of the anodic oxide film is marked with: the symbol "○" when the roughness ratio was smaller than 80%; the symbol "Δ" when the roughness ratio was larger than or equal to 80% and smaller than 100%; and the symbol "X" when the roughness ratio was 100%.

TABLE 5

| Test sample | Si content (wt %) in base material | Damage width (mm) | Damage ratio (%) | Surface roughness (μm Ra) |
|---|---|---|---|---|
| Test sample 1 | 12 | 2.0 | 100 | 2.7 |
| Test sample 2 | 12 | 1.7 | 35 | 2.1 |

| Test sample | Roughness ratio (%) | Ni content (at %) in anodic oxide film | Evaluation results: Damage resistance | Evaluation results: Surface roughness |
|---|---|---|---|---|
| Test sample 1 | 100 | 0.1 | — | — |
| Test sample 2 | 76 | 76 | ○ | ○ |

It is noted that, in the test sample 2, not only nickel (Ni) but also zinc (Zn) were confirmed as being contained as the metal deposit 16 in the anodic oxide film 20.

The thus-obtained test samples 1 and 2 were tested and evaluated in the same manner as in Experiment 1.

Figure 13:
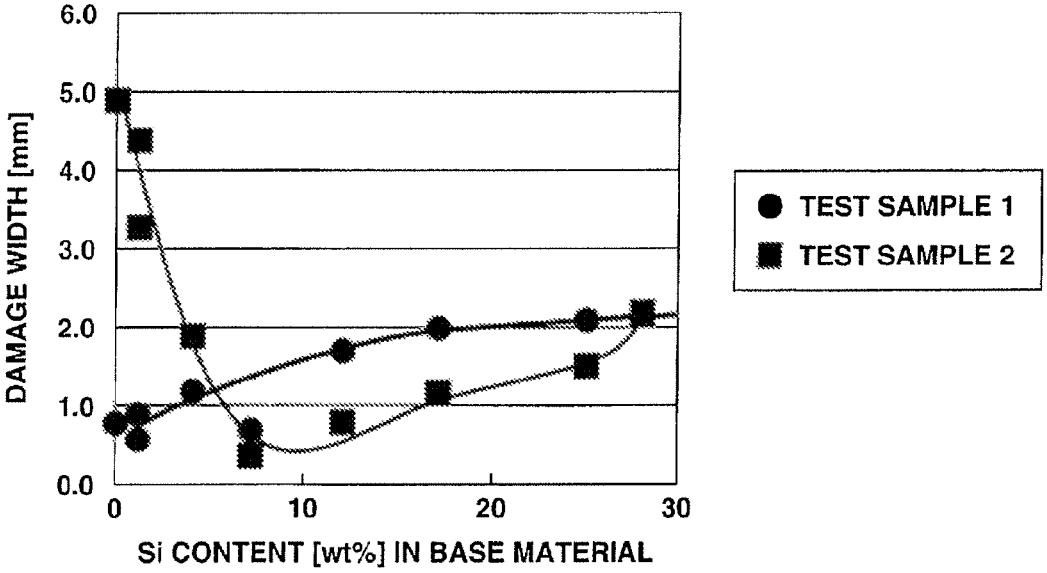
FIGS. 13 and 14 are graphs showing results of Experiment 2.
Figure 14:
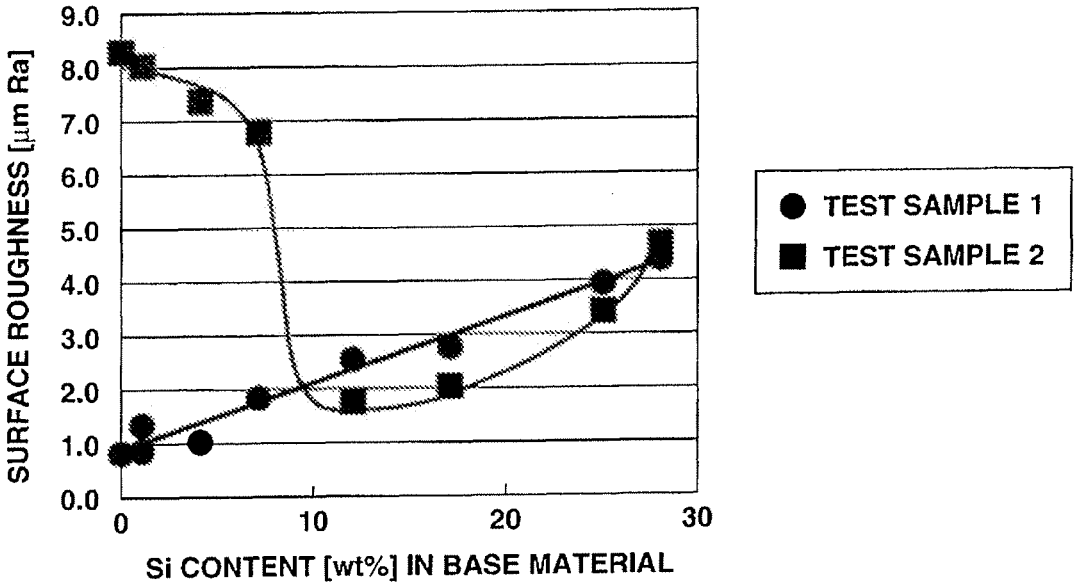

The test/evaluation results of the test samples 1 and 2 are indicated in TABLE 7 and FIGS. 13 and 14. In TABLE 7, the damage resistance of the anodic oxide film is marked with: the symbol "○" when the test sample 2 was reinforced relative to the test sample 1 (the damage ratio was smaller than 100%); and the symbol "X" when the test sample 2 was deteriorated relative to the test sample 2 (the damage ratio was larger than or equal to 100%); and the surface roughness of the anodic oxide film is marked with: the symbol "○" when the test sample 2 was smoothened relative to the test sample 2 (the roughness ratio was smaller than 100%); and the symbol "X" when the test sample 2 was deteriorated relative the test sample 1 (the roughness ratio was larger than or equal to 100%).

TABLE 7

| Test sample | Si content (wt %) in base material | Damage width (mm) | Damage ratio (%) | Surface roughness (μm Ra) |
|---|---|---|---|---|
| Test sample 1 | 0 | 0.8 | 100 | 0.8 |
| | 1 | 0.6 | 100 | 1.4 |
| | 1 | 0.9 | 100 | 0.9 |
| | 4 | 1.2 | 100 | 1.0 |
| | 7 | 0.7 | 100 | 1.9 |
| | 12 | 1.7 | 100 | 2.5 |
| | 17 | 2.0 | 100 | 2.8 |
| | 25 | 2.1 | 100 | 3.9 |

TABLE 7-continued

| | | | | |
|---|---|---|---|---|
| | 28 | 2.2 | 100 | 4.4 |
| Test sample 2 | 0 | 4.9 | 613 | 8.3 |
| | 1 | 3.3 | 550 | 8.2 |
| | 1 | 4.4 | 489 | 8.0 |
| | 4 | 1.9 | 158 | 7.4 |
| | 7 | 0.4 | 57 | 6.8 |
| | 12 | 0.8 | 47 | 1.8 |
| | 17 | 1.2 | 60 | 2.1 |
| | 25 | 1.5 | 71 | 3.4 |
| | 28 | 2.2 | 100 | 4.7 |

| | Roughness | Ni content | Evaluation results | |
|---|---|---|---|---|
| Test sample | ratio (%) | (at %) in anodic oxide film | Damage resistance | Surface roughness |
| Test sample 1 | 100 | 0.0 | — | — |
| | 100 | 0.0 | — | — |
| | 100 | 0.0 | — | — |
| | 100 | 0.0 | — | — |
| | 100 | 0.0 | — | — |
| | 100 | 0.0 | — | — |
| | 100 | 0.0 | — | — |
| | 100 | 0.0 | — | — |
| | 100 | 0.0 | — | — |
| Test sample 2 | 988 | 0.0 | x | x |
| | 599 | 0.1 | x | x |
| | 930 | 0.1 | x | x |
| | 718 | 0.1 | x | x |
| | 366 | 0.6 | ○ | x |
| | 70 | 1.3 | ○ | ○ |
| | 74 | 1.1 | ○ | ○ |
| | 87 | 1.1 | ○ | ○ |
| | 107 | 0.4 | x | x |

In Experiment 2, not only nickel (Ni) but also zinc (Zn) were confirmed as being contained as the metal deposit 16 in the anodic oxide film 20 of the test sample 2 as in the case of Experiment 1, except for the case where the silicon content of the base material 1*b* was 0 wt %".

As is seen from TABLE 7 and FIG. 13, the test sample 2 has a damage ratio of smaller than 100% (a damage width of smaller than 2.2 mm) relative to the test sample 1 when the silicon content of the base material 1*b* was 7 to 25 wt %. It can thus be said that the silicon content of the base material 1*b* is preferably 7 to 25 wt % in order to secure the damage resistance of the anodic oxide film 20. Further, the test sample 2 had a roughness ratio of smaller than 100% (a surface roughness Ra of smaller than 4.4 μm) relative to the test sample 1 when the silicon content of the base material 1*b* was from about 12 to 25 wt % as is seen from TABLE 13 and FIG. 14. It is assumed from FIG. 14 that, in terms of surface roughness, the acceptable lower limit of the silicon content of the base material 1*b* is 10 wt % although there is no direct data on such test sample. It can thus be said that the silicon content of the base material 1*b* is more preferably 10 to 25 wt % in order to combine the damage resistance and surface roughness of the anodic oxide film 20.

The reason for the above results is considered as follows. When the silicon content of the base material 1*b* is too low, there occur less clearances 25 and recesses 26 in the anodic oxide film 20. The anodic oxide film 20 is thus unlikely to be deteriorated in damage resistance and surface roughness even in the case where only the anodization treatment is performed. In the case where the electrolytic deposition treatment is performed in combination with the anodization treatment, however, there arises a difficulty in the passage of electric current due to the less clearances 25 of the anodic oxide film 20 so that the anodic oxide film 20 becomes damaged (e.g. broken) by the application of a high voltage during the electrolytic deposition treatment. Further, the metal 16 cannot be deposited adequately due to the less clearances 25 and recesses 26 of the anodic oxide film 20 and becomes a cause of surface roughness. On the other hand, when the silicon content of the base material 1*b* is too high, there occur many clearances 25 and recesses 26 in the anodic oxide film 20. The anodic oxide film 20 is thus likely to be deteriorated in damage resistance and surface roughness in the case where only the anodization treatment is performed. In the case where the electrolytic deposition treatment is performed in combination with the anodization treatment, the metal 16 cannot deposited in a sufficient amount to fill the many clearances 25 and recesses 26 of the anodic oxide film 20 so that the anodic oxide film 20 becomes deteriorated in damage resistance and surface roughness.

[Experiment 3: Influence of Thickness of Anodic Oxide Film on Film Performance]

Test samples 1 and 2 were prepared in the same manner as in Experiments 1 and 2 by varying the thickness of the anodic oxide film 20 in a range of 5 to 60 μm.

The treatment conditions are summarized in TABLE 8.

TABLE 8

| Step | Conditions |
|---|---|
| Material and Pretreatment | Base material: AC8A<br>(aluminum alloy casting according to JIS H5202)<br>Thickness: 5 mm<br>Treatment area: 0.029 $dm^2$ (19 mm × 15 mm)<br>Degreasing: ultrasonic cleaning in acetone<br>Treatment temperature: room temperature<br>Treatment time: 5 minutes<br>Masking agent: KT Clean AC-818T<br>(manufactured by Kakoki Trading Co., Ltd.) |
| Anodization | Electrolytic solution: sulfuric acid (200 g/L)<br>Treatment temperature: 25 ± 5° C.<br>Cathode: pure titanium<br>Current density: DC (direct current) 10.0 $A/dm^2$<br>Treatment time: 1.3 to 15.0 minutes<br>Anodic oxide film thickness: 5 to 60 μm |
| Washing/drying | Washing with water of pH 5.8 to 8.6<br>Treatment time: 1 minute<br>Drying with air blow |
| Electrolytic deposition | Electrolytic solution:<br>Nickel sulfamate 300 g/L<br>Zinc sulfate 30 g/L<br>Boric acid 30 g/L<br>Treatment temperature: 35 ± 5° C.<br>Anode: pure nickel<br>Current density: DC (direct current) 2.1 $A/dm^2$<br>Treatment time: 9 minutes |
| Washing/drying | Washing with water of pH 5.8 to 8.6<br>Treatment time: 1 minute<br>Drying with air blow |

The thus-obtained test samples 1 and 2 were tested and evaluated in the same manner as in Experiments 1 and 2.

Figure 15:
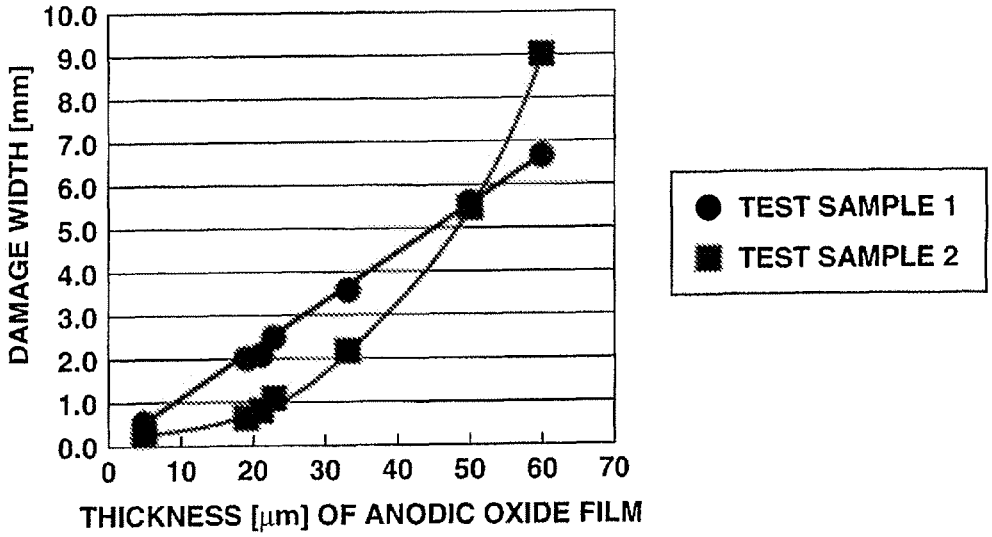
FIG. 15 is a graph showing results of Experiment 3.

The test/evaluation results of the test samples 1 and 2 are indicated in TABLE 9 and FIG. 15. In TABLE 9, the damage resistance of the anodic oxide film is marked with: the symbol "○" when the test sample 2 was reinforced relative to the test sample 1 (the damage ratio was smaller than 100%); and the symbol "X" when the test sample 2 was deteriorated relative to the test sample 2 (the damage ratio was larger than or equal to 100%).

TABLE 9

| Test sample | Thickness (μm) of anodic oxide film | Damage width (mm) | Damage ratio (%) | Evaluation results Damage resistance |
|---|---|---|---|---|
| Test sample 1 | 5 | 0.5 | — | — |
| | 19 | 2.0 | — | — |
| | 21 | 2.1 | — | — |
| | 23 | 2.5 | — | — |
| | 33 | 3.6 | — | — |
| | 50 | 5.6 | — | — |
| | 60 | 6.7 | — | — |
| Test sample 2 | 5 | 0.2 | 40 | ○ |
| | 19 | 0.7 | 35 | ○ |
| | 21 | 0.8 | 38 | ○ |
| | 23 | 1.1 | 44 | ○ |
| | 33 | 2.2 | 60 | ○ |
| | 50 | 5.5 | 98 | ○ |
| | 60 | 9.0 | 134 | x |

In Experiment 3, not only nickel (Ni) but also zinc (Zn) were confirmed as being contained as the metal deposit 16 in the anodic oxide film 20 of the test sample 2 as in the case of Experiments 1 and 2.

As is seen from TABLE 9 and FIG. 15, the damage width of the test sample 1 increased approximately linearly with the thickness of the anodic oxide film 20. By contrast, the damage width of the test sample 2 increased with the thickness of the anodic oxide film 20 in a quadratic curve manner as is seen from TABLE 9 and FIG. 15. The test sample 2 had a damage ratio of smaller than 100% (a damage width of smaller than about 5.5 mm) when the thickness of the anodic oxide film 20 was 5 to 50 μm. It can thus be said that the thickness of the anodic oxide film is preferably 5 to 50 μm in order to secure the damage resistance of the anodic oxide film 20.

The reason for the above results is considered as follows. Regardless of whether the electrolytic deposition treatment is performed in combination with the anodization treatment or not, the anodic oxide film 20 is high in rigidity and shows high damage resistance when the thickness of the anodic oxide film 20 is relatively small. However, there occur many clearances 25 and recesses 26 in the anodic oxide film 20 when the thickness of the anodic oxide film 20 is too large. In the case where only the anodization treatment is performed, the anodic oxide film 20 is likely to be damaged (e.g. cracked) by impact due to the many clearances 25 and recesses 26 and thus be deteriorated in damage resistance. Even in the case where the electrolytic deposition treatment is performed in combination with the anodization treatment, the anodic oxide film 20 becomes deteriorated in damage resistance as the amount of the deposited metal 16 does not keep up with the amount of the clearances 25 and clearances 26 in the anodic oxide film 20.

[Experiment 4: Influence of Ni Content of Anodic Oxide Film on Film Performance]

Test samples 1 and 2 were prepared in the same manner as in Experiments 1 to 3 by using aluminum alloy materials a to h of different component ratios as a base material 1*b* and, in the case of the test sample 2 using the aluminum alloy material e as the base material 1*b*, varying the treatment area, current density and treatment time of the electrolytic deposition treatment. The compositions of the respective aluminum alloy materials a to h used are indicated in TABLE 10.

TABLE 10

| Base material | Chemical composition (wt %) Cu | Si | Mg | Zn | Fe | Mn | Ti | Ni | Al |
|---|---|---|---|---|---|---|---|---|---|
| a | ≤0.1 | ≤0.1 | 2.5-4.0 | ≤0.40 | ≤0.8 | 0.4-0.6 | ≤0.20 | ≤0.1 | balance |
| b | 0.1 | 0.1 | 0.0 | 0.02 | 0.3 | 0.0 | 0.00 | 0.0 | balance |
| c | 0.1 | 3.9 | 0.0 | 0.02 | 0.3 | 0.0 | 0.00 | 0.0 | balance |
| d | ≤0.2 | 6.5-7.5 | 0.2-0.4 | ≤0.30 | ≤0.5 | ≤0.6 | ≤0.20 | 0.1-1.5 | balance |
| e | 0.8-1.3 | 11.0-13.0 | 0.7-1.3 | ≤0.15 | ≤0.8 | ≤0.15 | ≤0.20 | 0.8-1.5 | balance |
| f | 2.2 | 17.1 | 1.1 | 0.01 | 0.2 | 0.0 | 0.01 | 1.4 | balance |
| g | 0.1 | 24.9 | 0.0 | 0.02 | 0.3 | 0.0 | 0.00 | 0.0 | balance |
| h | 0.1 | 27.9 | 0.0 | 0.02 | 0.3 | 0.0 | 0.00 | 0.0 | balance |

The thus-obtained test samples 1 and 2 were tested and evaluated in the same manner as in Experiments 1 to 3.

Figure 16:
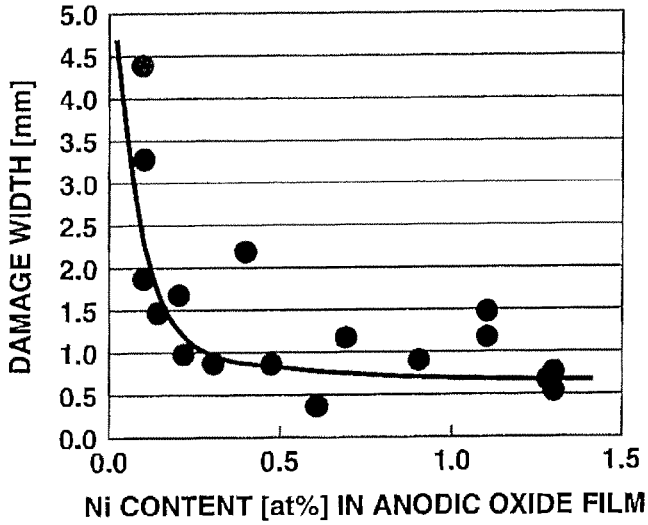
FIG. 16 is a graph showing results of Experiment 4.

The test/evaluation results of the test sample 2 are indicated in TABLE 11 and FIG. 16 so as to verify the influence of the nickel content of the anodic oxide film 20 on the damage resistance and surface roughness. In TABLE 11, the damage resistance of the anodic oxide film is marked with: the symbol "○" when the damage ratio was smaller than 50%; the symbol "Δ" when the damage ratio was larger than or equal to 50% and smaller than 80%; and the symbol "X" when the damage ratio was larger than or equal to 80%; and the surface roughness of the anodic oxide film is marked with: the symbol "○" when the roughness ratio was smaller than 80%; the symbol "Δ" when the roughness ratio was larger than or equal to 80% and smaller than 100%; and the symbol "X" when the roughness ratio was larger than or equal to 100%.

TABLE 11

| No. | Base material | Si content (wt %) in base material | Treatment area ($dm^2$) | Current density ($A/dm^2$) | Treatment time (min) | Damage width (mm) |
|---|---|---|---|---|---|---|
| 1 | a | 1 | 0.029 | 2.1 | 9.0 | 3.3 |
| 2 | b | 1 | 0.029 | 2.1 | 9.0 | 4.4 |
| 3 | c | 4 | 0.029 | 2.1 | 9.0 | 1.9 |

TABLE 11-continued

| | | | | | | |
|---|---|---|---|---|---|---|
| 4 | d | 7 | 0.029 | 2.1 | 9.0 | 0.4 |
| 5 | e | 12 | 0.146 | 0.5 | 9.0 | 0.9 |
| 6 | e | 12 | 0.146 | 1.6 | 9.0 | 0.6 |
| 7 | e | 12 | 0.146 | 4.1 | 9.0 | 0.9 |
| 8 | e | 12 | 0.029 | 2.1 | 0.7 | 1.5 |
| 9 | e | 12 | 0.029 | 7.0 | 0.7 | 1.7 |
| 10 | e | 12 | 0.029 | 0.4 | 2.8 | 1.0 |
| 11 | e | 12 | 0.029 | 0.4 | 9.0 | 0.9 |
| 12 | e | 12 | 0.029 | 2.1 | 9.0 | 0.7 |
| 13 | e | 12 | 0.029 | 2.1 | 9.0 | 0.8 |
| 14 | e | 12 | 0.029 | 7.0 | 9.0 | 1.2 |
| 15 | f | 17 | 0.029 | 2.1 | 9.0 | 1.2 |
| 16 | g | 25 | 0.029 | 2.1 | 9.0 | 1.5 |
| 17 | h | 28 | 0.029 | 2.1 | 9.0 | 2.2 |

| | Damage | Surface | Roughness | Ni content | Evaluation results | |
|---|---|---|---|---|---|---|
| No. | ratio (%) | roughness (μm Ra) | ratio (%) | (at %) in anodic oxide film | Damage resistance | Surface roughness |
| 1 | 550 | 8.2 | 599 | 0.1 | x | x |
| 2 | 489 | 8.0 | 930 | 0.1 | x | x |
| 3 | 158 | 7.4 | 718 | 0.1 | x | x |
| 4 | 57 | 6.8 | 366 | 0.6 | ○ | x |
| 5 | 53 | 1.9 | 62 | 0.3 | Δ | ○ |
| 6 | 34 | 1.9 | 62 | 1.3 | ○ | ○ |
| 7 | 55 | 3.3 | 110 | 0.9 | Δ | x |
| 8 | 83 | 2.5 | 74 | 0.1 | x | ○ |
| 9 | 94 | 3.2 | 116 | 0.2 | x | x |
| 10 | 59 | 2.5 | 99 | 0.2 | Δ | Δ |
| 11 | 45 | 2.9 | 106 | 0.5 | ○ | x |
| 12 | 35 | 2.1 | 76 | 1.3 | ○ | ○ |
| 13 | 47 | 1.8 | 70 | 1.3 | ○ | ○ |
| 14 | 60 | 7.2 | 265 | 0.7 | Δ | x |
| 15 | 60 | 2.1 | 74 | 1.1 | ○ | ○ |
| 16 | 71 | 3.4 | 87 | 1.1 | ○ | ○ |
| 17 | 100 | 4.7 | 107 | 0.4 | x | x |

In Experiment 4, not only nickel (Ni) but also zinc (Zn) were confirmed as being contained as the metal deposit 16 in the anodic oxide film 20 of the test sample 2 as in the case of Experiments 1 to 3.

As is seen from TABLE 11 and FIG. 16, the test sample 2 has a damage ratio of smaller than 80% and a roughness ratio of smaller than 100% when the nickel content of the anodic oxide film 20 was 0.3 atomic %. It can thus be said that the nickel content of the anodic oxide film 20 is preferably 0.3 atomic % in order to secure both of the damage resistance and surface roughness of the anodic oxide film 20. This preferable nickel content range is determined, in view of reliability, as where at least one of the damage roughness and surface roughness of the anodic oxide film 20 was evaluated as "○" rather than where both of the damage roughness and surface roughness of the anodic oxide film 20 was evaluated as "Δ".

[Experiment 5: Influence of Electrolytic Deposition Conditions on Film Performance]

Test samples 1 and 2 were prepared in the same manner as in Experiments 1 to 4 by varying the current density and treatment time of the electrolytic deposition treatment. In this experiment, the maximum limit of the electrolytic deposition treatment time was set to 9 minutes because the electrolytic deposition treatment time exceeding 9 minutes would cause a large deviation from the appropriate manufacturing time of the piston 1 and thus would not be practical.

The treatment conditions are summarized in TABLE 12.

TABLE 8

| Step | Conditions |
|---|---|
| Material and Pretreatment | Base material: AC8A<br>(aluminum alloy casting according to JIS H5202)<br>Thickness: 5 mm<br>Treatment area: 0.029 $dm^2$ (19 mm × 15 mm)<br>Degreasing: ultrasonic cleaning in acetone<br>Treatment temperature: room temperature<br>Treatment time: 5 minutes<br>Masking agent: KT Clean AC-818T<br>(manufactured by Kakoki Trading Co., Ltd.) |
| Anodization | Electrolytic solution: sulfuric acid (200 g/L)<br>Treatment temperature: 25 ± 5° C.<br>Cathode: pure titanium<br>Current density: DC (direct current) 10.0 $A/dm^2$<br>Treatment time: 5 minutes<br>Anodic oxide film thickness: 20 μm |
| Washing/drying | Washing with water of pH 5.8 to 8.6<br>Treatment time: 1 minute<br>Drying with air blow |
| Electrolytic deposition | Electrolytic solution:<br>Nickel sulfamate 300 g/L<br>Zinc sulfate 30 g/L<br>Boric acid 30 g/L<br>Treatment temperature: 35 ± 5° C.<br>Anode: pure nickel<br>Current density: DC (direct current) 0.4 to 8.8 $A/dm^2$<br>Treatment time: 0.7 to 9.0 minutes |
| Washing/drying | Washing with water of pH 5.8 to 8.6<br>Treatment time: 1 minute<br>Drying with air blow |

The thus-obtained test samples 1 and 2 were tested and evaluated in the same manner as in Experiments 1 to 4.

Figure 17:
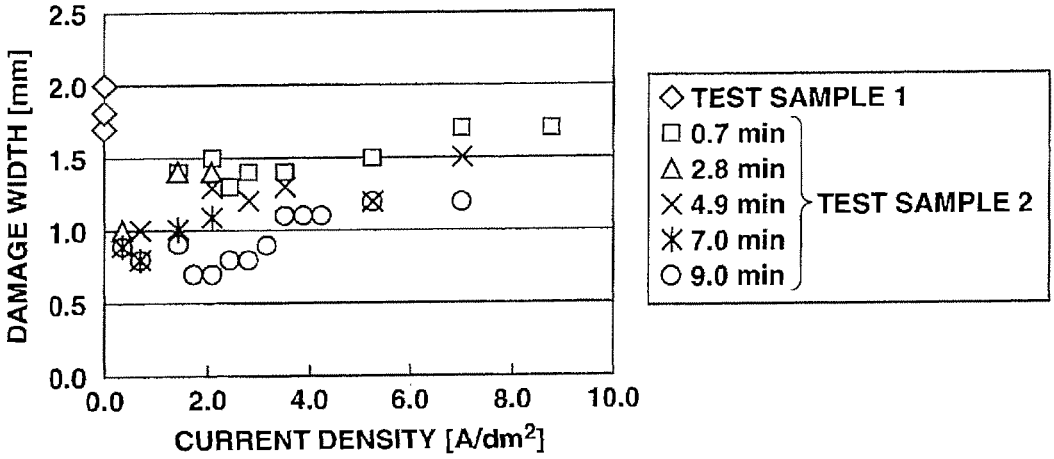
FIGS. 17 and 18 are graphs showing results of Experiment 5.
Figure 18:
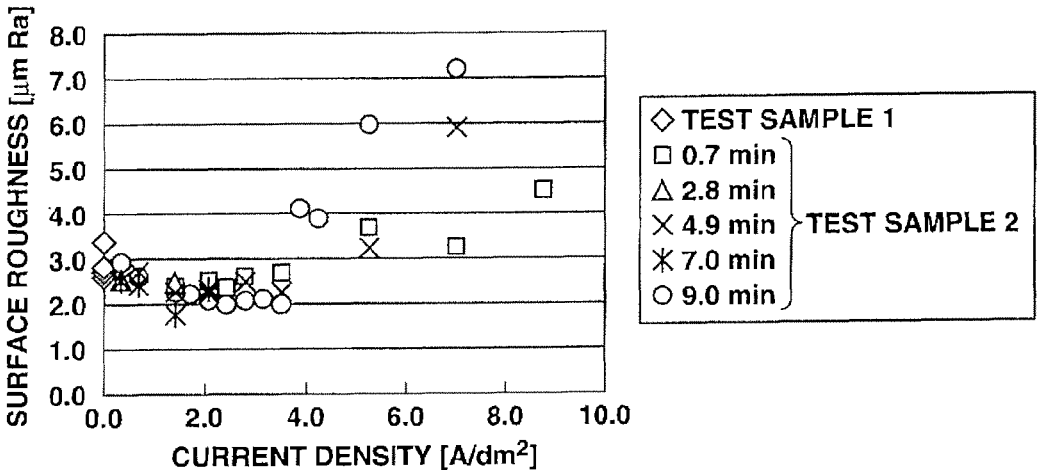

The test/evaluation results are indicated in TABLE 13 and FIGS. 17 and 18. In TABLE 11, the damage resistance of the anodic oxide film is marked with: the symbol "○" when the damage ratio was smaller than 50%; the symbol "Δ" when the damage ratio was larger than or equal to 50% and smaller than 80%; and the symbol "X" when the damage ratio was larger than or equal to 80%; and the surface roughness of the anodic oxide film is marked with: the symbol "○" when the roughness ratio was smaller than 80%; the symbol "Δ" when the roughness ratio was larger than or equal to 80% and smaller than 100%; and the symbol "X" when the roughness ratio was larger than or equal to 100%.

TABLE 13

| No. | Current density (A/dm$^2$) | Treatment time (min) | Damage width (mm) | Damage ratio (%) | Surface roughness (μm Ra) |
|---|---|---|---|---|---|
| 1 | 0.0 | 0.0 | 2.0 | 100 | 2.7 |
| 2 | 0.0 | 0.0 | 1.8 | 100 | 3.3 |
| 3 | 0.0 | 0.0 | 1.8 | 100 | 2.6 |
| 4 | 0.0 | 0.0 | 1.8 | 100 | 2.8 |
| 5 | 0.0 | 0.0 | 1.7 | 100 | 2.5 |
| 6 | 1.4 | 0.7 | 1.4 | 78 | 2.4 |
| 7 | 2.1 | 0.7 | 1.5 | 83 | 2.5 |
| 8 | 2.5 | 0.7 | 1.3 | 72 | 2.3 |
| 9 | 2.8 | 0.7 | 1.4 | 78 | 2.6 |
| 10 | 3.5 | 0.7 | 1.4 | 78 | 2.7 |
| 11 | 5.3 | 0.7 | 1.5 | 83 | 3.7 |
| 12 | 7.0 | 0.7 | 1.7 | 94 | 3.2 |
| 13 | 8.8 | 0.7 | 1.7 | 94 | 4.5 |
| 14 | 0.4 | 2.8 | 1.0 | 59 | 2.5 |
| 15 | 1.4 | 2.8 | 1.4 | 78 | 2.5 |
| 16 | 2.1 | 2.8 | 1.4 | 78 | 2.2 |
| 17 | 0.4 | 4.9 | 0.9 | 53 | 2.5 |
| 18 | 0.7 | 4.9 | 1.0 | 56 | 2.7 |
| 19 | 1.4 | 4.9 | 1.0 | 56 | 2.3 |
| 20 | 2.1 | 4.9 | 1.3 | 72 | 2.2 |
| 21 | 2.8 | 4.9 | 1.2 | 67 | 2.5 |
| 22 | 3.5 | 4.9 | 1.3 | 72 | 2.2 |
| 23 | 5.3 | 4.9 | 1.2 | 67 | 3.2 |
| 24 | 7.0 | 4.9 | 1.5 | 83 | 5.9 |
| 25 | 0.4 | 7.0 | 0.9 | 53 | 2.5 |
| 26 | 0.7 | 7.0 | 0.8 | 41 | 2.4 |
| 27 | 1.4 | 7.0 | 1.0 | 56 | 1.7 |
| 28 | 2.1 | 7.0 | 1.1 | 61 | 2.3 |
| 29 | 0.4 | 9.0 | 0.9 | 45 | 2.9 |
| 30 | 0.7 | 9.0 | 0.8 | 40 | 2.6 |
| 31 | 1.4 | 9.0 | 0.9 | 50 | 2.2 |
| 32 | 1.8 | 9.0 | 0.7 | 35 | 2.2 |
| 33 | 2.1 | 9.0 | 0.7 | 35 | 2.1 |
| 34 | 2.5 | 9.0 | 0.8 | 40 | 2.0 |
| 35 | 2.8 | 9.0 | 0.8 | 40 | 2.1 |
| 36 | 3.2 | 9.0 | 0.9 | 45 | 2.1 |
| 37 | 3.5 | 9.0 | 1.1 | 55 | 2.0 |
| 38 | 3.9 | 9.0 | 1.1 | 55 | 4.1 |
| 39 | 4.2 | 9.0 | 1.1 | 55 | 3.9 |
| 40 | 5.3 | 9.0 | 1.2 | 60 | 6.0 |
| 41 | 7.0 | 9.0 | 1.2 | 60 | 7.2 |

| No. | Roughness ratio (%) | Ni content (at %) in anodic oxide film | Evaluation results: Damage resistance | Evaluation results: Surface roughness |
|---|---|---|---|---|
| 1 | 100 | | — | — |
| 2 | 100 | | — | — |
| 3 | 100 | | — | — |
| 4 | 100 | | — | — |
| 5 | 100 | | — | — |
| 6 | 85 | | Δ | Δ |
| 7 | 74 | 0.1 | x | ○ |
| 8 | 70 | | Δ | ○ |
| 9 | 77 | | Δ | ○ |
| 10 | 95 | | Δ | x |
| 11 | 110 | | x | Δ |
| 12 | 116 | 0.2 | x | x |
| 13 | 161 | | x | x |
| 14 | 99 | 0.2 | Δ | Δ |
| 15 | 88 | | Δ | Δ |
| 16 | 64 | | Δ | ○ |
| 17 | 99 | | Δ | Δ |
| 18 | 96 | | Δ | Δ |
| 19 | 80 | | Δ | Δ |
| 20 | 67 | | Δ | ○ |
| 21 | 96 | | Δ | Δ |
| 22 | 88 | | Δ | Δ |
| 23 | 126 | | Δ | x |
| 24 | 211 | | x | x |
| 25 | 97 | | x | Δ |
| 26 | 94 | | ○ | Δ |
| 27 | 62 | | Δ | ○ |
| 28 | 70 | 0.5 | Δ | ○ |
| 29 | 106 | | ○ | x |
| 30 | 96 | | ○ | Δ |
| 31 | 79 | | ○ | ○ |
| 32 | 80 | | ○ | ○ |
| 33 | 76 | 1.3 | ○ | ○ |
| 34 | 75 | | ○ | ○ |
| 35 | 77 | | ○ | Δ |
| 36 | 77 | | ○ | ○ |
| 37 | 75 | | Δ | ○ |
| 38 | 151 | | Δ | x |
| 39 | 142 | | Δ | x |
| 40 | 221 | | Δ | x |
| 41 | 265 | 0.7 | Δ | x |

It is assumed based on the results of Experiments 1 to 4 that nickel (Ni) and zinc (Zn) were contained as the metal deposit 16 in the anodic oxide film 20 of the test sample 2 even in Experiment 5 although the nickel content of the anodic oxide film 20 was not measured and indicated for every sample.

As is seen from TABLE 13 and FIGS. 17 and 18, the test sample 2 has a damage ratio of smaller than 100% (a damage width of smaller than about 1.7 mm) and a roughness ratio of smaller than 100% (a surface roughness Ra of smaller than about 2.5 μm) relative to the test sample 1 when the current density was 0.4 to 3.5 A/dm$^2$. It can thus be said that the electrolytic deposition treatment is preferably performed at a current density of 0.4 to 3.5 A/dm$^2$ in order to secure the damage resistance and surface roughness of the anodic oxide film 20. It has also been confirmed that the longer the treatment time of the electrolytic deposition treatment, the more advantageous it is in terms of both damage resistance and surface roughness.

The reason for the above results is considered as follows. The metal 16 cannot be deposited sufficiently in the clearances 25 and recesses 26 of the anodic oxide film 20 so that the anodic oxide film 20 becomes deteriorated in damage resistance and surface roughness when the current density is too low. When the current density is too high, by contrast, the deposition of the metal 16 is concentrated on the place where the electric current is easy to pass (that is, the metal 16 is concentratedly deposited on the surface of the anodic oxide film 20 where the electrical resistance is relatively small, rather than in the clearances 25 of the anodic oxide film 20 where the electrical resistance is relatively large) so as to cause significant deterioration in surface roughness. The metal 16 cannot also be deposited sufficiently so that the anodic oxide film 20 becomes deteriorated in damage resistance and surface roughness when the treatment time is too short.

[Experiment 6: Influence of Electrolytic Solution Concentration on Film Performance]

Test samples 1 and 2 were prepared in the same manner as in Experiments 1 to 5 by varying the electrolytic solution and current density of the electrolytic deposition treatment. The reagent concentrations of the respective electrolytic solutions used are indicated in TABLE 14.

TABLE 14

| Electrolytic solution | Reagent concentration (g/L) | | |
|---|---|---|---|
| | Nickel sulfamate | Zinc sulfate | Boric acid |
| A | 100 | 10 | 30 |
| B | 300 | 30 | 30 |
| C | 600 | 60 | 30 |
| D | 100 | — | 30 |
| E | 300 | — | 30 |

The thus-obtained test samples 1 and 2 were tested and evaluated in the same manner as in Experiments 1 to 5.

Figure 19:
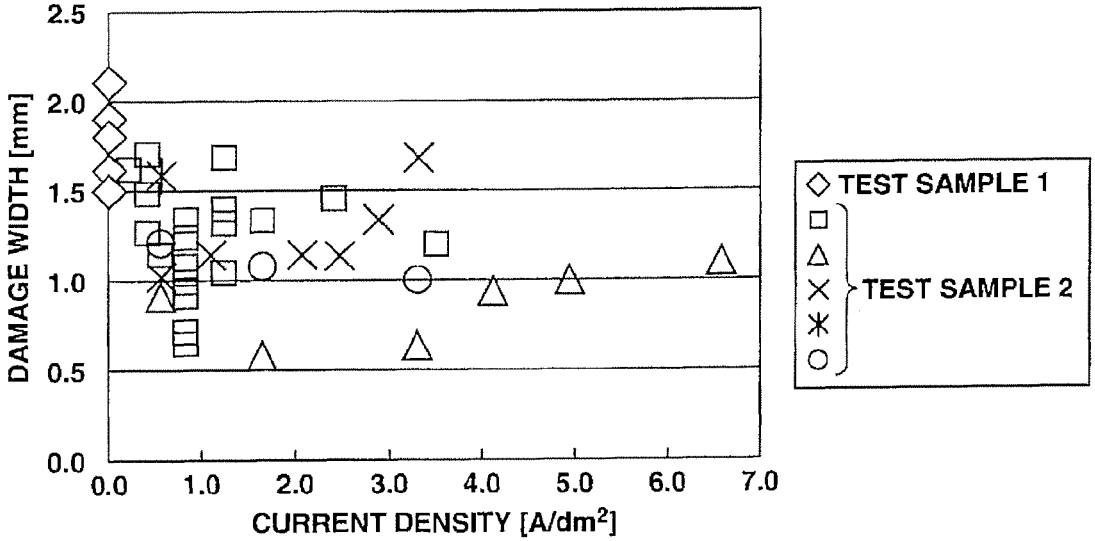
FIGS. 19 and 20 are graphs showing results of Experiment 6.
Figure 20:
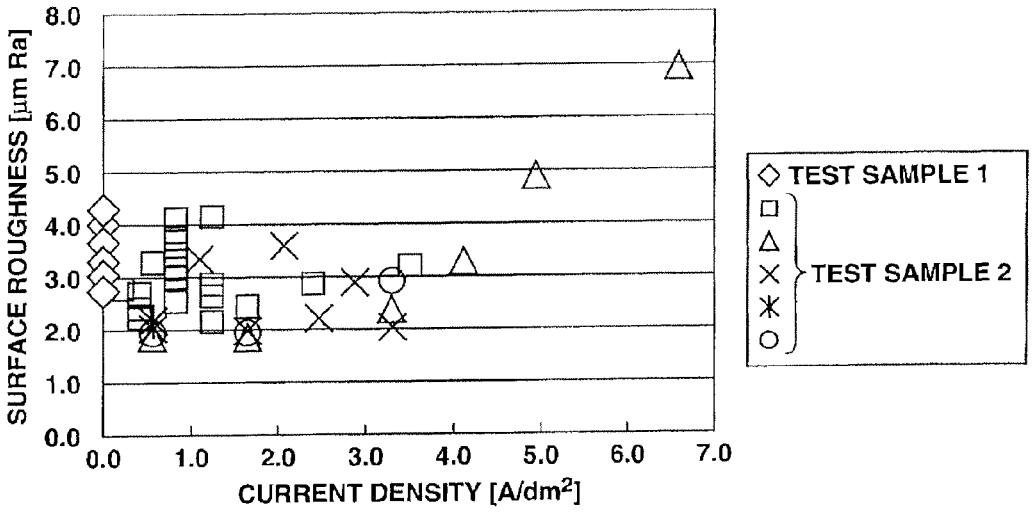

The test/evaluation results are indicated in TABLE 15 and FIGS. 19 and 20. In TABLE 15, the damage resistance of the anodic oxide film is marked with: the symbol "○" when the damage ratio was smaller than 50%; the symbol "Δ" when the damage ratio was larger than or equal to 50% and smaller than 80%; and the symbol "X'" when the damage ratio was larger than or equal to 80%; and the surface roughness of the anodic oxide film is marked with: the symbol "○" when the roughness ratio was smaller than 80%; the symbol "Δ" when the roughness ratio was larger than or equal to 80% and smaller than 100%; and the symbol "X" when the roughness ratio was larger than or equal to 100%.

TABLE 15

| No. | Treatment condition | Electrolytic solution | Current density ($A/dm^2$) | Treatment time (min) | Damage width (mm) |
|---|---|---|---|---|---|
| 1 | anodization | — | 0.0 | 0.0 | 1.9 |
| 2 | anodization | — | 0.0 | 0.0 | 1.8 |
| 3 | anodization | — | 0.0 | 0.0 | 2.1 |
| 4 | anodization | — | 0.0 | 0.0 | 1.5 |
| 5 | anodization | — | 0.0 | 0.0 | 1.6 |
| 6 | anodization | — | 0.0 | 0.0 | 1.8 |
| 7 | anodization | — | 0.0 | 0.0 | 1.5 |
| 8 | anodization + electrolytic deposition | A | 0.2 | 30.0 | 1.6 |
| 9 | anodization + electrolytic deposition | A | 0.4 | 3.0 | 1.7 |
| 10 | anodization + electrolytic deposition | A | 0.4 | 9.0 | 1.5 |
| 11 | anodization + electrolytic deposition | A | 0.4 | 15.0 | 1.5 |
| 12 | anodization + electrolytic deposition | A | 0.4 | 30.0 | 1.3 |
| 13 | anodization + electrolytic deposition | A | 0.5 | 9.0 | 1.1 |
| 14 | anodization + electrolytic deposition | A | 0.8 | 0.7 | 1.2 |
| 15 | anodization + electrolytic deposition | A | 0.8 | 3.0 | 1.0 |
| 16 | anodization + electrolytic deposition | A | 0.8 | 6.0 | 1.3 |
| 17 | anodization + electrolytic deposition | A | 0.8 | 9.0 | 1.1 |
| 18 | anodization + electrolytic deposition | A | 0.8 | 15.0 | 0.9 |
| 19 | anodization + electrolytic deposition | A | 0.8 | 30.0 | 0.7 |
| 20 | anodization + electrolytic deposition | A | 0.8 | 60.0 | 1.0 |
| 21 | anodization + electrolytic deposition | A | 0.8 | 120.0 | 0.7 |
| 22 | anodization + electrolytic deposition | A | 1.2 | 0.7 | 1.7 |
| 23 | anodization + electrolytic deposition | A | 1.2 | 2.0 | 1.0 |
| 24 | anodization + electrolytic deposition | A | 1.2 | 6.0 | 1.4 |
| 25 | anodization + electrolytic deposition | A | 1.2 | 9.0 | 1.3 |
| 26 | anodization + electrolytic deposition | A | 1.6 | 9.0 | 1.3 |
| 27 | anodization + electrolytic deposition | A | 2.4 | 9.0 | 1.5 |
| 28 | anodization + electrolytic deposition | A | 3.5 | 0.7 | 1.2 |
| 29 | anodization + electrolytic deposition | B | 0.5 | 9.0 | 0.9 |
| 30 | anodization + electrolytic deposition | B | 1.6 | 9.0 | 0.6 |
| 31 | anodization + electrolytic deposition | B | 3.3 | 9.0 | 0.6 |
| 32 | anodization + electrolytic deposition | B | 4.1 | 9.0 | 0.9 |
| 33 | anodization + electrolytic deposition | B | 4.9 | 9.0 | 1.0 |
| 34 | anodization + electrolytic deposition | B | 6.6 | 9.0 | 1.1 |
| 35 | anodization + electrolytic deposition | C | 0.5 | 9.0 | 1.0 |
| 36 | anodization + electrolytic deposition | C | 1.1 | 9.0 | 1.1 |
| 37 | anodization + electrolytic deposition | C | 1.6 | 9.0 | 1.1 |
| 38 | anodization + electrolytic deposition | C | 2.1 | 9.0 | 1.1 |
| 39 | anodization + electrolytic deposition | C | 2.5 | 9.0 | 1.1 |
| 40 | anodization + electrolytic deposition | C | 2.9 | 9.0 | 1.3 |
| 41 | anodization + electrolytic deposition | C | 3.3 | 9.0 | 1.7 |
| 42 | anodization + electrolytic deposition | D | 0.5 | 9.0 | 1.6 |
| 43 | anodization + electrolytic deposition | E | 0.5 | 9.0 | 1.2 |
| 44 | anodization + electrolytic deposition | E | 1.6 | 9.0 | 1.1 |
| 45 | anodization + electrolytic deposition | E | 3.3 | 9.0 | 1.0 |

| No. | Damage ratio (%) | Surface roughness (μm Ra) | Roughness ratio (%) | Ni content (at %) in anodic oxide film | Evaluation results | |
|---|---|---|---|---|---|---|
| | | | | | Damage resistance | Surface roughness |
| 1 | 100 | 3.7 | 100 | 0.1 | — | — |
| 2 | 100 | 4.3 | 100 | 0.1 | — | — |
| 3 | 100 | 3.0 | 100 | 0.1 | — | — |
| 4 | 100 | 4.0 | 100 | 0.1 | — | — |
| 5 | 100 | 3.1 | 100 | 0.1 | — | — |
| 6 | 100 | 2.7 | 100 | 0.1 | — | — |

TABLE 15-continued

| | | | | | | |
|---|---|---|---|---|---|---|
| 7 | 100 | 3.3 | 100 | 0.1 | — | — |
| 8 | 95 | 2.8 | 93 | | x | Δ |
| 9 | 100 | 2.5 | 83 | | x | Δ |
| 10 | 87 | 2.5 | 82 | | x | Δ |
| 11 | 87 | 2.2 | 74 | | x | ○ |
| 12 | 74 | 2.7 | 90 | | Δ | Δ |
| 13 | 67 | 3.3 | 110 | | Δ | x |
| 14 | 73 | 2.5 | 84 | | Δ | Δ |
| 15 | 60 | 3.7 | 123 | 0.6 | Δ | x |
| 16 | 79 | 2.8 | 93 | | Δ | Δ |
| 17 | 63 | 3.2 | 106 | | Δ | x |
| 18 | 53 | 3.0 | 98 | | Δ | Δ |
| 19 | 39 | 3.1 | 102 | 1.2 | ○ | x |
| 20 | 60 | 4.1 | 137 | | Δ | x |
| 21 | 42 | 3.5 | 118 | 1.1 | ○ | x |
| 22 | 99 | 2.2 | 72 | | x | ○ |
| 23 | 62 | 4.1 | 138 | | Δ | x |
| 24 | 82 | 2.7 | 88 | | x | Δ |
| 25 | 78 | 2.8 | 95 | | Δ | Δ |
| 26 | 79 | 2.5 | 82 | 0.6 | Δ | Δ |
| 27 | 85 | 2.9 | 96 | | x | Δ |
| 28 | 70 | 3.2 | 107 | | Δ | x |
| 29 | 53 | 1.9 | 62 | 0.3 | Δ | ○ |
| 30 | 34 | 1.9 | 62 | 1.3 | ○ | ○ |
| 31 | 38 | 2.4 | 79 | | ○ | ○ |
| 32 | 55 | 3.3 | 110 | 0.9 | Δ | x |
| 33 | 59 | 4.9 | 164 | | Δ | x |
| 34 | 65 | 7.0 | 232 | | Δ | x |
| 35 | 60 | 2.2 | 73 | 0.2 | Δ | ○ |
| 36 | 67 | 3.4 | 112 | | Δ | x |
| 37 | 64 | 2.0 | 67 | 0.5 | Δ | ○ |
| 38 | 67 | 3.6 | 120 | | Δ | x |
| 39 | 67 | 2.2 | 74 | | Δ | ○ |
| 40 | 79 | 2.9 | 97 | | Δ | Δ |
| 41 | 99 | 2.1 | 69 | 0.3 | x | ○ |
| 42 | 94 | 2.0 | 67 | | x | ○ |
| 43 | 71 | 2.0 | 65 | | Δ | ○ |
| 44 | 63 | 2.0 | 66 | | Δ | ○ |
| 45 | 59 | 2.9 | 98 | | Δ | Δ |

It is assumed based on the results of Experiments 1 to 4 that nickel (Ni) and zinc (Zn) were contained as the metal deposit 16 in the anodic oxide film 20 of the test sample 2 even in Experiment 6, although the nickel content of the anodic oxide film 20 was not measured and indicated for every sample, as in the case of Experiment 5.

As is seen from TABLE 15 and FIGS. 19 and 20, both of the damage width and surface roughness of the anodic oxide film 20 were made small by the use of either the electrolytic solution B or the electrolytic solution E when the current density was in the preferable range of 0.4 to 3.5 A/dm$^2$. In particular, the damage width and surface roughness of the anodic oxide film 20 were minimized by the use of the electrolytic solution B. It can thus be said that it is advantageous to use the electrolytic solution of relatively high nickel sulfamate concentration. It has also been confirmed by comparison of the electrolytic solutions A and D and comparison of the electrolytic solutions B and E that the damage width of the anodic oxide film 20 was made smaller with the addition of the zinc sulfate than with the addition of no zinc sulfate.

The reason for the above results is considered that the Ni content of the anodic oxide film 20, i.e., the amount of the metal deposit 16 in the anodic oxide film 20 is increased as the nickel sulfamate concentration of the electrolytic solution is high. In particular, the deposition of nickel is effectively accelerated by the coexistence of zinc during the electrolytic deposition treatment.

[Experiment 7: Influence of Electrolytic Solution Concentration on Film Performance]

Test samples 1 and 2 were prepared in the same manner as in Experiments 1 to 6 by varying the reagent concentration of the electrolytic solution. The reagent concentrations of the respective electrolytic solutions used are indicated in TABLE 16.

TABLE 16

| | Reagent concentration (g/L) | | |
|---|---|---|---|
| Electrolytic solution | Nickel sulfamate | Zinc sulfate | Boric acid |
| A | 50 | 5 | 30 |
| B | 100 | 10 | 30 |
| C | 200 | 20 | 30 |
| D | 300 | 30 | 30 |
| E | 400 | 40 | 30 |
| F | 500 | 50 | 30 |
| G | 600 | 60 | 30 |
| H | 700 | 70 | 30 |

The thus-obtained test samples 1 and 2 were tested and evaluated in the same manner as in Experiments 1 to 6.

Figure 21:
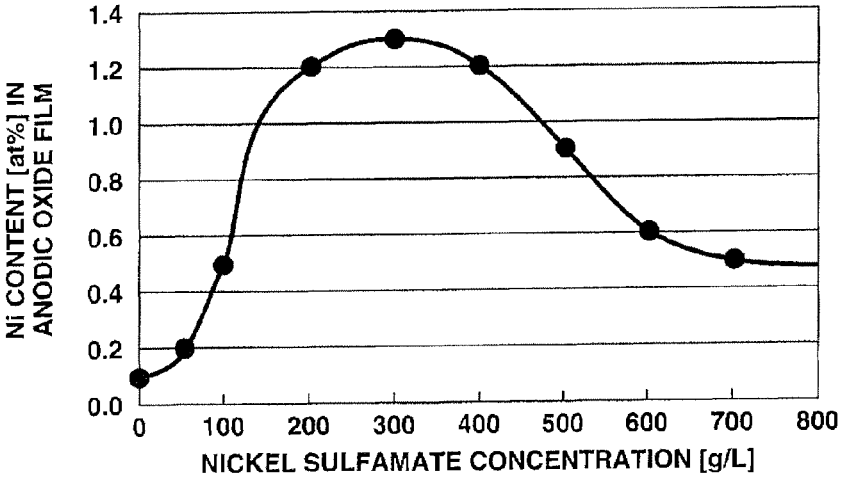
FIG. 21 is a graph showing results of Experiment 7.

The test/evaluation results are indicated in TABLE 17 and FIG. 21. In TABLE 17, the damage resistance of the anodic oxide film is marked with: the symbol "○" when the damage ratio was smaller than 50%; the symbol "Δ" when the damage ratio was larger than or equal to 50% and smaller than 80%; and the symbol "×" when the damage ratio was larger than or equal to 80%; and the surface roughness of the anodic oxide film is marked with: the symbol "○" when the roughness ratio was smaller than 80%; the symbol "Δ" when the roughness ratio was larger than or equal to 80% and smaller than 100%; and the symbol "X" when the roughness ratio was larger than or equal to 100%.

TABLE 17

| No. | Treatment condition | Electrolytic solution | Nickel sulfamate concentration (g/L) | Damage width (mm) | Damage ratio (%) |
|---|---|---|---|---|---|
| 1 | anodization | — | 0 | 2.0 | 100 |
| 2 | anodization + electrolytic deposition | A | 50 | 1.6 | 80 |
| 3 | anodization + electrolytic deposition | B | 100 | 1.3 | 65 |
| 4 | anodization + electrolytic deposition | C | 200 | 0.8 | 40 |
| 5 | anodization + electrolytic deposition | D | 300 | 0.7 | 35 |
| 6 | anodization + electrolytic deposition | E | 400 | 0.8 | 40 |
| 7 | anodization + electrolytic deposition | F | 500 | 1.0 | 50 |
| 8 | anodization + electrolytic deposition | G | 600 | 1.1 | 55 |
| 9 | anodization + electrolytic deposition | H | 700 | 1.3 | 65 |

| No. | Surface roughness (mm Ra) | Roughness ratio (%) | Ni content (at %) in anodic oxide film | Evaluation results: Damage resistance | Evaluation results: Surface roughness |
|---|---|---|---|---|---|
| 1 | 2.7 | 100 | 0.1 | x | x |
| 2 | 2.6 | 96 | 0.2 | Δ | Δ |
| 3 | 2.4 | 89 | 0.5 | Δ | Δ |
| 4 | 2.2 | 79 | 1.2 | ○ | ○ |
| 5 | 2.1 | 76 | 1.3 | ○ | ○ |
| 6 | 2.1 | 77 | 1.2 | ○ | ○ |
| 7 | 2.3 | 85 | 0.9 | Δ | Δ |
| 8 | 2.5 | 92 | 0.6 | Δ | Δ |
| 9 | 2.5 | 92 | 0.5 | Δ | Δ |

In Experiment 7, not only nickel (Ni) but also zinc (Zn) were confirmed as being contained as the metal deposit 16 in the anodic oxide film 20 of the test sample 2 as in the case of Experiments 1 to 4.

As is seen from TABLE 17 and FIG. 21, good results were not obtained when the nickel sulfamate concentration of the electrolytic solution was too low or too high (100 g/L or lower or 500 g/L or higher as in the electrolytic solution A, B and F to H). Among others, the electrolytic solution D in which the nickel sulfamate concentration was 300 g/L led to the best results.

The reason for the above results is considered as follows. When the nickel sulfamate concentration of the electrolytic solution is too low, the anodic oxide film 20 cannot obtain sufficient improvement in damage resistance and surface roughness due to less nickel content of the anodic oxide film 20, i.e., insufficient amount of the deposited metal 16 in the anodic oxide film 20. When the nickel sulfamate concentration of the electrolytic solution is too high and exceeds a given level, the deposition speed of the metal 16 becomes increased with the amount of nickel ions ($Ni^{2+}$) in the electrolytic solution. In this case, the deposition of the metal 16 is concentrated on the place where the electric current is easy to pass (the metal 16 is concentratedly deposited on the surface of the anodic oxide film 20 where the electrical resistance is relatively small, rather than in the clearances 25 of the anodic oxide film 20 where the electrical resistance is relatively large) so as to cause significant deterioration in surface roughness, as in the case where the current density is too high during the electrolytic deposition treatment.

As described above, the anodic oxide film 20 in which the high-strength metal 16 such as nickel and zinc is deposited around the silicon particles 24 in the clearances 25 is formed by combination of the anodization treatment and the electrolytic deposition treatment in the present embodiment. In general, it is likely that the anodic oxide film 20 will be broken from the clearances 25 in the occurrence of cracking. In the present embodiment, however, such breakage-prone clearances 25 are filled with and reinforced by the deposited high-strength metal 16. It is therefore possible for the anodic oxide film 20 to secure sufficient strength such as resistance to damage/impact by explosive combustion in the combustion chamber C.

In addition, not only the clearances 25 inside the anodic oxide film 20 but also the recesses 26 in the surface of the anodic oxide film 20 are filled with the deposited metal 16. It is thus possible to impart surface smoothness to the anodic oxide film 20.

It is further possible to improve the heat radiation properties of the piston 1 as the metal 16 deposited in the recesses 26 of the anodic oxide film 20 is in contact with the piston base material 1*b* so as to allow radiation of heat from the piston 1 (piston base material 1*b*) to the outside (cylinder block 2) through the piston ring PL1.

For effective reinforcement of the anodic oxide film 20, the silicon content of the piston base material 1*b* is preferably 7 to 25 wt % based on the total weight of the piston base material 1*b*. One specific example of the Al—Si piston base material 1*b* is, but is not limited to, AC8A. When the silicon content of the piston base material 1*b* is too high, there are formed many clearances 25 around the silicon particles 24 so that the amount of the deposited metal 16 may not keep up with the amount of the clearances 25. This leads to deterioration in damage/impact resistance of the anodic oxide film 20. When the silicon content of the piston base material 1*b* is too low, on the other hand, there are formed less clearances 25 around the silicon particles 24 in the anodic oxide film 20. This raises a difficulty in the passage of electric current so that the anodic oxide film 20 may be broken under the application of a high voltage during the electrolytic deposition treatment. It is possible to keep balance between the amount of the clearances 25 and the amount of the deposited metal 16 and secure the sufficient strength of the anodic oxide film 20 when the silicon content of the piston base material 1*b* is controlled to within the above-specified relatively-low content range.

The silicon content of the piston base material 1*b* is more preferably 10 to 25 wt % based on the total weight of the piston base material 1*b* in order to keep balance between the amount of the clearances 25 and recesses 26 and the amount of the deposited metal 16 and thereby secure not only the sufficient strength but also adequate surface smoothness of the anodic oxide film 20.

Further, the thickness of the anodic oxide film 20 is preferably 5 to 50 μm. The amount of the clearances 25 in the anodic oxide film 20 increases with the thickness of the anodic oxide film 20. The amount of the deposited metal 16 may thus not keep up with the amount of the clearances 25 when the thickness of the anodic oxide film 20 is too large. This leads to deterioration in damage/impact resistance of the anodic oxide film 20 due to the clearances 25. When the thickness of the anodic oxide film 20 is too small, the anodic oxide film 20 itself may not secure sufficient strength and may become poor in damage/impact resistance. It is possible to keep balance between the amount of the clearances 25 and the amount of the deposited metal 16, while ensuring the minimum thickness of the anodic oxide film 20 required for sufficient damage/impact resistance, and secure the sufficient strength of the anodic oxide film 20 when the thickness of the anodic oxide film 20 is controlled within the above-specified relatively-small thickness range.

The nickel content of the anodic oxide film 20 is preferably 0.3 atomic % or more. It is possible to achieve proper reinforcement of the anodic oxide film 20 by the metal 16, limit the occurrence of damage to the anodic oxide film 20 by impact to within an acceptable range and secure the sufficient strength of the anodic oxide film 16 when the nickel content of the anodic oxide film 20 is controlled to be 0.3 atomic % or more.

Furthermore, the electrolytic deposition treatment is preferably performed at a current density of 0.4 to 3.5 A/dm$^2$. When the current density is too high, the deposition of the metal 16 is concentrated on the place where the metal 16 is easy to deposit (the electric current is easy to pass) so as to cause deterioration in surface roughness. The amount of the deposited metal 16 may become insufficient to fill the clearances 25 and recesses 26 of the anodic oxide film 20 so as to cause deterioration in damage/impact resistance and surface roughness when the current density is too low. When the current density is controlled to be 0.4 to 3.5 A/dm$^2$ in the electrolytic deposition treatment, it is possible to keep balance between the amount and distribution of the deposited metal 16 so that the anodic oxide film 20 can combine sufficient strength with surface smoothness.

One preferred example of the electrolytic solution 18 used in the electrolytic deposition treatment is an electrolytic solution containing nickel sulfamate at a concentration of 100 to 600 g/L. As the deposition of nickel is effectively accelerated by the coexistence of zinc during the electrolytic deposition treatment, it is preferable that the electrolytic solution contains zinc sulfate in addition to the nickel sulfamate. It is also preferable that the electrolytic solution contains boric acid.

Although the engine piston 1 is exemplified in the above embodiment, the present invention is applicable to any other aluminum alloy member such as a spool valve body or pump housing. It is possible to obtain the same effects as above even when the present invention is embodied as any other aluminum alloy member.

The entire contents of Japanese Patent Application No. 2012-203882 (filed on Sep. 18, 2012) and No. 2013-160028 (filed on Aug. 1, 2013) are herein incorporated by reference.

Although the present invention has been described with reference to the above exemplary embodiments, the present invention is not limited to these exemplary embodiments. Various modification and variation of the embodiments described above will occur to those skilled in the art in light of the above teachings.

Depending on the specifications of the target product, it is feasible to provide the electrolytic deposition treatment region 15 on the entire area of the anodization treatment region 14 although the electrolytic deposition treatment region 15 is provided to the given area within the anodization treatment region 14 in the above embodiment. Although the anodization treatment region 14 and the electrolytic deposition treatment region 15 are provided on the top ring groove 11 in the above embodiment, it is feasible to provide the anodization treatment region 14 and the electrolytic deposition treatment region 15 on any part of the piston 1 such as the crown surface 6*a* and outer circumferential surface of the crown portion 6. The ranges of formation of the anodization treatment region 14 and the electrolytic deposition treatment region 15 can be set as appropriate depending on the specifications of the target product.

The scope of the present invention is defined with reference to the following claims.

What is claimed is:

1. A piston for an internal combustion engine, comprising:
a piston body made of an aluminum alloy material containing silicon and having a piston ring groove formed therein; and
an anodic oxide film formed on the piston ring groove,
wherein a metal containing nickel and zinc is deposited around silicon particles in the anodic oxide film.

2. The piston according to claim 1, wherein the aluminum alloy material has a silicon content of 7 to 25 wt %.

3. The piston according to claim 2, wherein the aluminum alloy material has a silicon content of 10 to 25 wt %.

4. The piston according to claim 1, wherein the anodic oxide film has a thickness of 5 to 50 μm.

5. The piston according to claim 1, wherein the anodic oxide film has a nickel content of 0.3 atomic % or more.

6. The piston according to claim 1, wherein a metal containing nickel and zinc is deposited at a part of a surface of the anodic oxide film.

7. The piston according to claim 6, wherein the metal deposited at the surface of the anodic oxide film is in contact with the aluminum alloy material at a location inside the anodic oxide film.

8. The piston according to claim 1, wherein the region of deposition of the metal is smaller than the region of formation of the anodic oxide film in an axial direction of the piston.

9. A method of manufacturing a piston for an internal combustion engine, comprising:
producing a piston with a piston ring groove from an aluminum alloy material containing silicon;
forming an anodic oxide film on the piston ring groove; and
electrolyzing, in an electrolytic solution, a part of the piston on which the anodic oxide film has been formed so as to allow a metal containing nickel and zinc to be deposited around silicon particles in the anodic oxide film.

10. The method according to claim 9, wherein the aluminum alloy material has a silicon content of 7 to 25 wt %.

11. The method according to claim 10, wherein the aluminum alloy material has a silicon content of 10 to 25 wt %.

12. The method according to claim 9, wherein the anodic oxide film has a thickness of 5 to 50 μm.

13. The method according to claim 9, wherein the anodic oxide film has a nickel content of 0.3 atomic % or more.

14. The method according to claim 9, wherein the electrolyzing is performed at a current density of 0.4 to 3.5 A/dm$^2$.

15. The method according to claim 9, wherein the electrolytic solution contains nickel sulfamate.

16. The method according to claim 15, wherein the concentration of the nickel sulfamate in the electrolytic solution is 100 to 600 g/L.

17. The method according to claim 15, wherein the electrolytic solution further contains boric acid.

18. The method according to claim 17, wherein the electrolytic solution father contains zinc sulfate.

19. The method according to claim 9, wherein the region of deposition of the metal is smaller than the region of formation of the anodic oxide film in an axial direction of the piston.

20. An aluminum alloy member, comprising:
a base body made of an aluminum alloy material containing silicon; and
an anodic oxide film formed on at least a part of the base body,
wherein a metal containing nickel and zinc is deposited around silicon particles in the anodic oxide film.

* * * * *